US007394189B2

(12) United States Patent
Kitagawa et al.

(10) Patent No.: US 7,394,189 B2
(45) Date of Patent: Jul. 1, 2008

(54) COMPACT SELF-BALLASTED FLUORESCENT LAMP HAVING A CIRCUIT BOARD WITH CONNECTION MEMBERS

(75) Inventors: Hiroki Kitagawa, Takatsuki (JP); Shiro Iida, Kyoto (JP); Akiko Nakanishi, Hirakata (JP); Yasushige Tomiyoshi, Takatsuki (JP); Toshikatsu Kotaki, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 418 days.

(21) Appl. No.: 10/506,069

(22) PCT Filed: Mar. 28, 2003

(86) PCT No.: PCT/JP03/03950

§ 371 (c)(1),
(2), (4) Date: Jun. 9, 2005

(87) PCT Pub. No.: WO03/083360

PCT Pub. Date: Oct. 9, 2003

(65) Prior Publication Data

US 2005/0231120 A1 Oct. 20, 2005

(30) Foreign Application Priority Data

Mar. 29, 2002 (JP) ..... 2002-096641
Mar. 29, 2002 (JP) ..... 2002-096642

(51) Int. Cl.
*H01J 5/48* (2006.01)
*H01J 5/50* (2006.01)

(52) U.S. Cl. ..... 313/318.1; 313/317; 313/318.01; 313/318.02; 313/318.07; 313/318.12

(58) Field of Classification Search ..... 313/317–318.12
See application file for complete search history.

(56) References Cited

U.S. PATENT DOCUMENTS 5,705,883 A * 1/1998 Soules et al. ..... 313/318.09
5,828,170 A * 10/1998 Nishio et al. ..... 313/493

FOREIGN PATENT DOCUMENTS

| | | |
|---|---|---|
| JP | 2-29604 | 8/1990 |
| JP | 0-7240178 | 9/1995 |
| JP | 2002-033003 | 1/2002 |

* cited by examiner

*Primary Examiner*—Joseph L. Williams
*Assistant Examiner*—Bumsuk Won

(57) ABSTRACT

An objective is to provide a compact self-ballasted fluorescent lamp which can reduce occurrence of a short circuit without protecting lead wires extending from each end portion of a spiral arc tube. To achieve the objective, a pair of connection pins is provided on a circuit board of the compact self-ballasted fluorescent lamp, near a periphery of the circuit board so as to oppose another pair of connection pins formed near the periphery. In this way, the pairs of connection pins can be respectively provided directly above the end portions of the spiral arc tube. Thus, lead wires extending from each of the end portions can be connected to a corresponding one of the pairs of connection pins with a relatively short distance. This prevents the lead wires from being in contact with the circuit board, thereby reducing occurrence of a short circuit.

7 Claims, 18 Drawing Sheets

COMPACT SELF-BALLASTED FLUORESCENT LAMP HAVING A CIRCUIT BOARD WITH CONNECTION MEMBERS

TECHNICAL FIELD

The present invention relates to a compact self-ballasted fluorescent lamp including a spiral arc tube.

BACKGROUND ART

In recent years, compact self-ballasted fluorescent lamps are increasingly used as an alternative for incandescent lamps, which require high power consumption. A compact self-ballasted fluorescent lamp has the same cap as an incandescent lamp and has a fluorescent lamp as a light emitting unit.

The compact self-ballasted fluorescent lamp includes, for example, an arc tube which is formed by spirally winding a glass tube except for end portions, where the end portions are vertically straight (i.e. leg portions), a holder to which the end portions of the arc tube are attached, a drive circuit unit that is attached to the holder and used for driving the arc tube, and a case that houses the drive circuit unit. In addition, two lead wires extend from each of the end portions of the arc tube which are attached to the holder, and are connected to the drive circuit unit. The lead wires are electrically conductive so as to supply power with a filament.

The drive circuit unit is generally formed in such a manner that a capacitor and a transistor are mounted on a printed circuit board. Furthermore, connection pins are provided on the circuit board, so as to connect the lead wires extending from each end portion of the arc tube to the drive circuit unit. The arc tube and the drive circuit unit are electrically connected to each other by winding the lead wires around the connection pins. Alternatively, the connection pins may be formed by wire-like components which are easily bent. In this case, the arc tube and the drive circuit unit are electrically connected to each other in such a manner that the lead wires and the connection pins are twisted together and then soldered. It should be noted here that all of the connection pins are gathered together in an area, for example, aligned in line, on the circuit board in order to achieve smaller circuit and board sizes.

In an attempt to increase an amount of light emission, a new arc tube has recently been developed for self-ballasted fluorescent lamps. In detail, each end portion of the new arc tube is spirally wound in a spiral direction of the arc tube, unlike the above-described conventional arc tube which has end portions which are vertically straight with respect to the holder. The new arc tube is hereinafter referred to as a spiral arc tube.

When comparing this new spiral arc tube with the conventional arc tube, the new spiral arc tube has approximately four spirals, while the conventional arc tube only has approximately three spirals. Thus, the new spiral arc tube has a larger light emission area. As a result, the new spiral arc tube achieves a larger amount of light emission than the conventional arc tube having the leg portions.

In the spiral arc tube, end portions, from each of which two lead wires extend, are positioned so as to oppose each other when seen from above. As describe above, however, the connection pins are gathered together in an area on the circuit board. Accordingly, lead wires extending from at least one of the end portions of the spiral arc tube need to be bent towards the connection pins, in order to be connected to the connection pins on the circuit board. In other words, one of the end portions of the spiral arc tube is more distant from the connection pins than the other end portion is. This poses the following problem specific to the spiral arc tube in which the end portions are spirally wound in the spiral direction. That is, the lead wires extending from one of the end portions which is positioned more distant from the connection pins need to be bent to be connected to the connection pins.

Despite their weakness, lead wires may be bent many times during a manufacturing process of the spiral arc tube. Accordingly, the lead wires tend to break due to a load of the bending. In addition, since the lead wires need to be long enough to be bent, the lead wires tend to easily contact with each other or with other constituents provided on the circuit board. This means that the new spiral arc tube has a high risk that the lead wires short-circuit. To prevent such a short circuit, the lead wires may be covered with an insulative material. However, this is not desirable since the number of constituents and the number of steps in the manufacturing process increase.

When a main light emitting portion of the spiral arc tube is faced downwards, the two lead wires extending from each end portion of the spiral arc tube are pulled up substantially vertically (in a direction along a spiral axis of the spiral arc tube), to be connected to the circuit board which is positioned directly above the spiral arc tube. Here, more short circuits occur between the lead wires, and between the lead wires and the circuit board in the new spiral arc tube than in the conventional arc tube having the leg portions. The reason for this is explained in the following.

In the conventional arc tube having the leg portions, the two lead wires extend from each vertically straight end portion. When such two lead wires are vertically pulled up towards the circuit board, an interval can be horizontally secured between the two lead wires. Thus, the lead wires do not overlap each other, and a short circuit is therefore less likely to occur. In the new spiral arc tube, on the other hand, each end portion is spirally wound in the spiral direction. Here, the two lead wires extending from each end portion are arranged vertically (in a direction along the height of the spiral arc tube, which is the same direction as the direction along the spiral axis of the spiral arc tube). In this case, when the two lead wires are pulled up substantially vertically to be connected to the circuit board, the lead wires are highly likely to overlap each other. Thus, a short circuit tends to occur between the lead wires. To prevent such a short circuit, the lead wires may be covered with an insulative material. However, this is not desirable since the number of constituents and the number of steps in the manufacturing process increase.

Here, the lead wires are fixed to each end portion of the spiral arc tube by pinching. Specifically speaking, each end portion of the spiral arc tube is melted and then pressed, so as to seal and fix the lead wires. However, this pinching method poses the following problem.

When the lead wires are wound around the connection pins provided on the circuit board to establish electrical connection, the lead wires may be strained. If such is the case, the lead wires may break or sealing portions of the spiral arc tube formed by pinching may break due to a tension produced in the lead wires. These breakages are more likely to happen when the connection pins are formed by wire-like components which are easily bent. This is because, in this case, the connection pins and the lead wires are twisted together using a pair of tweezers or the like, and a higher tension tends to be produced in the lead wires.

DISCLOSURE OF THE INVENTION

In light of the above-described problems, it is a first object of the present invention to prevent a lead wire in a compact self-ballasted fluorescent lamp from breaking. It is a second object of the present invention to prevent a short circuit that occurs between lead wires or between a lead wire and a circuit board without utilizing an insulating material.

The first object can be achieved by a compact self-ballasted fluorescent lamp including: a spiral arc tube in a double spiral configuration which is formed by spirally winding a glass tube from a middle portion thereof to both end portions thereof inclusive, where the spiral arc tube has pairs of electrically conductive lead wires that respectively support electrodes at the end portions; and a circuit board (i) on which pairs of connection members are provided so as to respectively connect the pairs of lead wires to the circuit board, and (ii) which applies a driving voltage to the electrodes through the pairs of lead wires to cause the spiral arc tube to emit light. Here, the pairs of connection members are respectively provided in a vicinity of the end portions.

According to this construction, the lead wires are bent at fewer times to be connected to the connection units. This prevents the lead wires from breaking.

Here, it is preferable the pairs of connection members are provided in a periphery portion of the circuit board so as to oppose each other, to correspond to the end portions of the spiral arc tube.

Here, the pairs of lead wires may have bending portions between the end portions and the pairs of connection members. Thus, an elasticity is produced in the lead wires. In this way, even when the lead wires are strained to be wound around the connection units, the lead wires are prevented from breaking. In addition, if the sealing portions of the end portions are formed by pinching, the sealing portions are also prevented from breaking. Here, the bending portion is a portion where the lead wire is bent at a right angle.

Here, the bending portions may be positioned more distant from the circuit board than the end portions are. Thus, the lead wires are positioned sufficiently distant from the circuit board. This realizes the second object of the present invention. Which is to say, this prevents a short circuit between the lead wires and the circuit board.

The second object can be achieved by a compact self-ballasted fluorescent lamp including: a spiral arc tube in a double spiral configuration which is formed by spirally winding a glass tube from a middle portion thereof to both end portions thereof inclusive, where the spiral arc tube has pairs of electrically conductive lead wires that respectively support electrodes at the end portions; and a circuit board which is positioned in a vicinity of the end portions of the spiral arc tube, and to which the pairs of lead wires are connected, and which applies a driving voltage to the electrodes through the pairs of lead wires to cause the spiral arc tube to emit light. Here, in each of the pairs of lead wires, lead wires extend from a corresponding one of the end portions, with an interval therebetween in a direction perpendicular to a spiral axis of the spiral arc tube.

According to this construction, when the lead wires are vertically pulled upwards in a direction along a spiral axis of the spiral arc tube, an interval is provided between the lead wires extending from each end portion, in a direction perpendicular to the direction along the spiral axis. As a result, since the lead wires do not overlap each other, a short circuit is prevented.

Here, a straight line connecting cross-sectional centers of the lead wires is tilted with respect to the spiral axis of the spiral arc tube.

Here, it is preferable that at the end portion, one of the lead wires closer to the circuit board is positioned more distant from the spiral axis of the spiral arc tube.

Here, the pairs of lead wires may have bending portions between the end portions and the pairs of connection members. This construction produces an elasticity for the lead wires. As a result, the lead wires and the end portions of the spiral arc tube are prevented from breaking.

Here, the bending portions may be positioned more distant from the circuit board than the end portions are. This prevents a short circuit between the lead wires and the circuit board.

The first and second objects are both achieved by a compact self-ballasted fluorescent lamp including: a spiral arc tube in a double spiral configuration which is formed by spirally winding a glass tube from a middle portion thereof to both end portions thereof inclusive, the spiral arc tube having pairs of electrically conductive lead wires that respectively support electrodes at the end portions; and a circuit board which is positioned in a vicinity of the end portions of the spiral arc tube, and on which pairs of connection members are provided so as to respectively connect the pairs of lead wires to the circuit board, and which applies a driving voltage to the electrodes through the pairs of lead wires to cause the spiral arc tube to emit light. Here, in each of the pairs of lead wires, lead wires extend from a corresponding one of the end portions, with an interval therebetween in a direction perpendicular to a spiral axis of the spiral arc tube, and the pairs of connection members are respectively provided in a vicinity of the end portions.

For the same reasons stated above, this construction reduces breakage of the lead wires and a short circuit between the lead wire and the circuit board.

BEST MODE FOR CARRYING OUT THE INVENTION

The following describes embodiments of the present invention with reference to the attached figures. The following embodiments and the figures only serve as an example, and the present invention is not limited to such.

First Embodiment

The following describes a compact self-ballasted fluorescent lamp with no globe relating to a first embodiment of the present invention, with reference to the attached figures.

(Construction of the Compact Self-Ballasted Fluorescent Lamp)

The following part first describes a construction of the compact self-ballasted fluorescent lamp relating to the first embodiment.

Figure 1A:
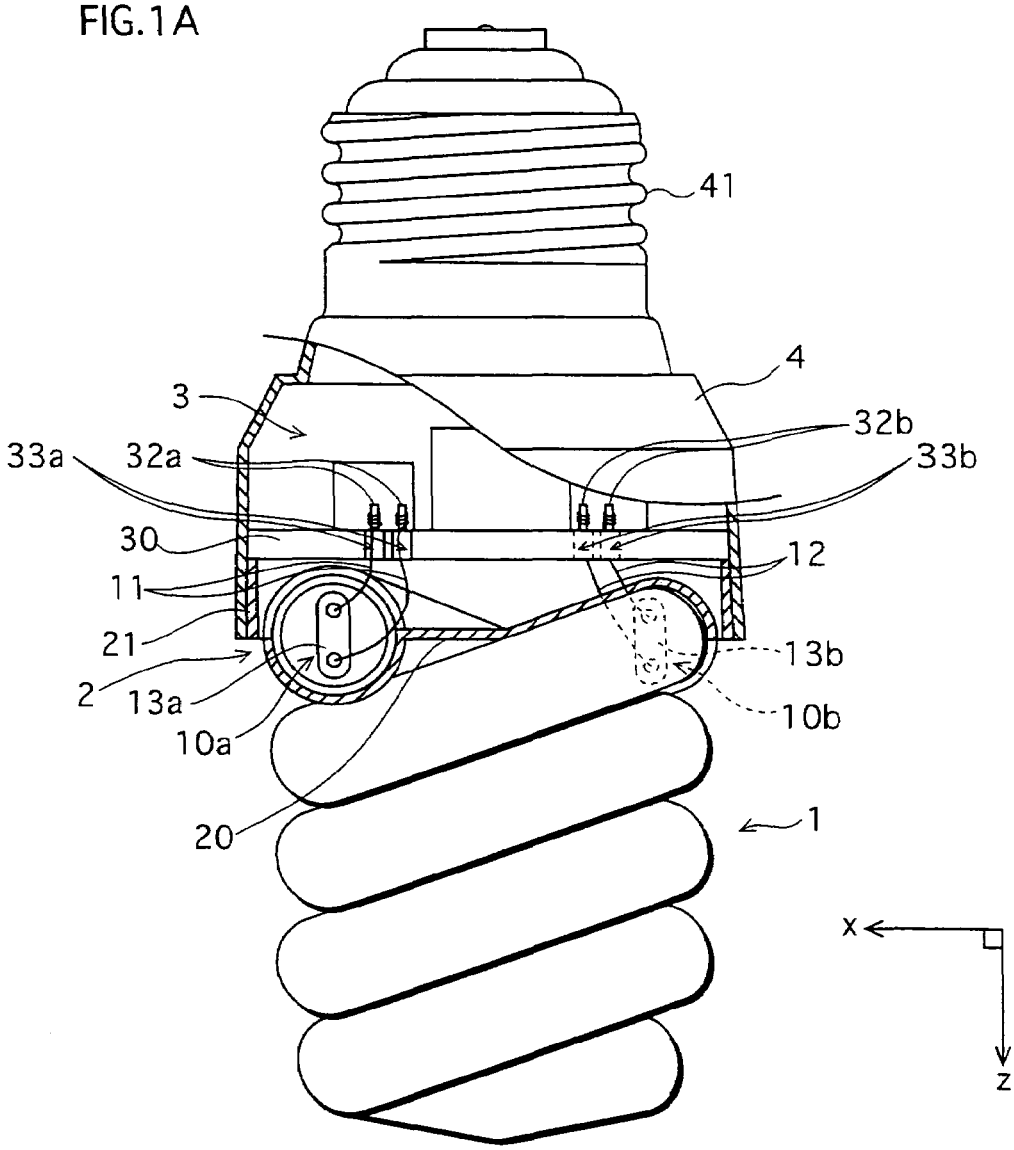
FIG. 1 is a front view illustrating a compact self-ballasted fluorescent lamp relating to a first embodiment, and shows an inner structure by removing a part of the lamp.
Figure 1B:
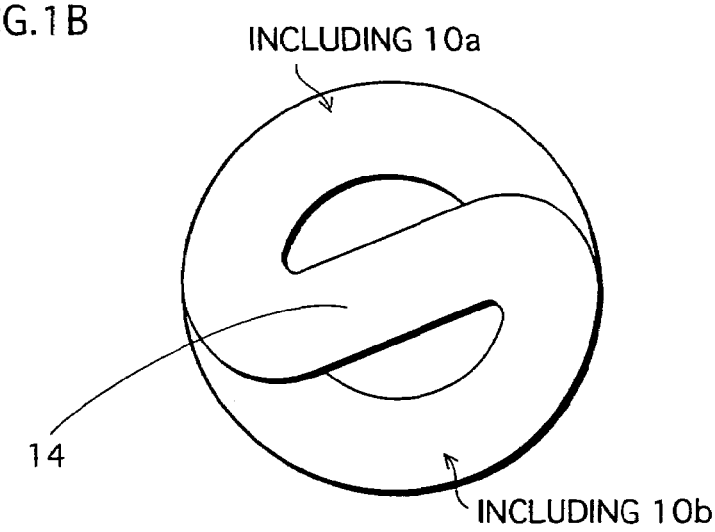
Figure 2:
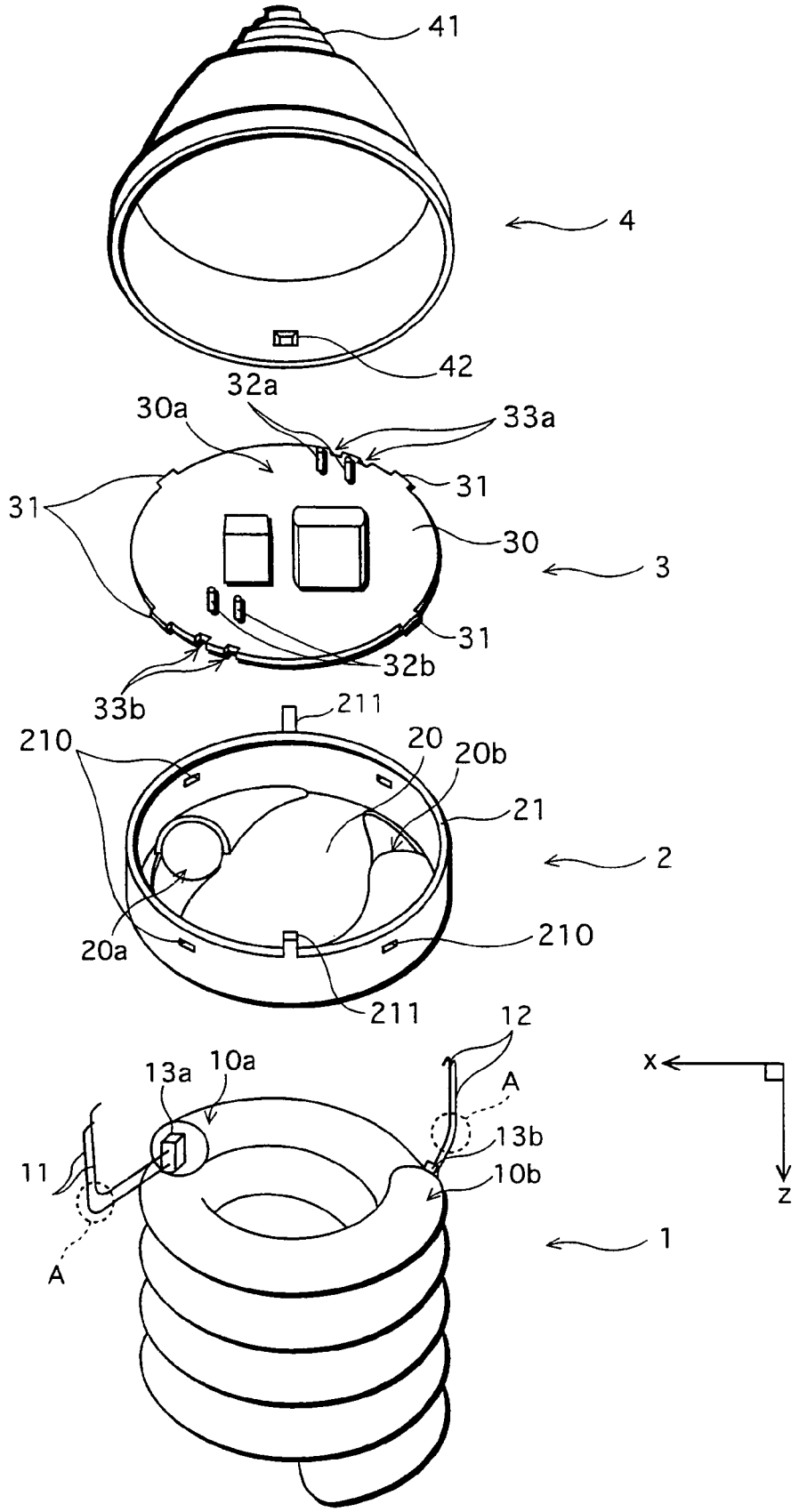
FIG. 2 is a perspective exploded view illustrating the compact self-ballasted fluorescent lamp relating to the first embodiment.

FIG. 1A is a front view illustrating the compact self-ballasted fluorescent lamp relating to the first embodiment, and shows an inner structure by removing part of the lamp, and FIG. 1B is a bottom plan view illustrating a spiral arc tube 1. FIG. 2 is an exploded view illustrating the compact self-ballasted fluorescent lamp relating to the first embodiment. FIG. 2 is a perspective view, in which constituents other than a case 4 are seen from above, and the case 4 is seen from below.

As shown in FIGS. 1A, 1B and 2, the compact self-ballasted fluorescent lamp includes the spiral arc tube 1 that has a spiral configuration and emits light, a holder 2 to which the spiral arc tube 1 is fixed, a drive circuit unit 3 that includes a circuit board 30 on which circuit units are provided to cause the spiral arc tube 1 to emit light, and the case 4 which houses the drive circuit unit 3 and to which the holder 2 is fixed.

The spiral arc tube 1 is formed by bending a glass tube. Here, a phosphor is applied on a tube inner surface of the glass tube. The spiral arc tube 1 has a double spiral configuration. In detail, the glass tube is spirally wound from a middle portion to both end portions inclusive. A pair of electrically conductive lead wires extends from each end portion, and supports an electrode at each end portion. In a conventional arc tube having leg portions, end portions are vertically straight (i.e. in a z-axis direction, a direction along a height of the arc tube, or a direction parallel to a spiral axis of the arc tube). In the spiral arc tube 1, on the other hand, end portions 10*a* and 10*b* are spirally wound in the spiral direction as shown in FIG. 2. As shown in FIG. 1B, the middle portion of the glass tube corresponds to a linear connection portion 14 of the spiral arc tube 1. The spiral arc tube 1 has a double spiral configuration which is formed in such a manner that the spirally wound glass tube is turned at the connection portion 14 corresponding to the middle portion.

In each of end portions 10*a* and 10*b* of the spiral arc tube 1, a filament (not shown) is provided. A pair of lead wires 11 and a pair of lead wires 12 respectively extend from the end portions 10*a* and 10*b*, and are respectively sealed and fixed by sealing portions 13*a* and 13*b*. The sealing portions 13*a* and 13*b* are formed by melting and pinching corresponding portions of the glass tube. To be wound around the a pair of connection pins 32*a* and a pair of connection pins 32*b* on the circuit board 30, the pairs of lead wires 11 and 12 are respectively pulled upwards from the sealing portions 13*a* and 13*b* in a direction substantially parallel to the z-axis direction as shown in FIG. 1A. Thus, when a voltage is applied to the filaments (not shown) provided in the spiral arc tube 1 through the pairs of lead wires 11 and 12, the filaments each emit an electron. The electron collides with mercury enclosed in the spiral arc tube 1 so that the mercury emits an ultraviolet ray. The ultraviolet ray excites the phosphor applied on the tube inner surface to emit light, so that the spiral arc tube 1 emits light.

The holder 2 is made of a resin and patelliform as shown in FIG. 2. The holder 2 includes a board 20 and a wall 21 that is provided around a periphery of the board 20.

Tunnel-like openings 20*a* and 20*b* are provided in the board 20 so as to be engaged with the respective end portions 10*a* and 10*b*. The spiral arc tube 1 is rotated so that the end portions 10*a* and 10*b* are respectively inserted into the openings 20*a* and 20*b*. In this way, the spiral arc tube 1 is fixed to the holder 2.

Openings 210 are provided in the wall 21 so as to correspond to protrusions 31 formed on the circuit board 30 as shown in FIG. 2. Protrusions 211 are provided on the wall 21 so as to correspond to openings 42 provided in the case 4. The protrusions 31 on the circuit board 30 are fitted into the openings 210 so that the holder 2 supports the circuit board 30. The protrusions 211 are fitted into the openings 42 in the case 4 so that the holder 2 is fixed to the case 4.

The drive circuit unit 3 is formed in such a manner that a drive unit 30*a* is provided on the circuit board 30. Here, the circuit board 30 is positioned in the vicinity of the end portions 10*a* and 10*b* of the spiral arc tube 1, and the drive unit 30*a* includes a transistor and a capacitor to drive the spiral arc tube 1.

The circuit board 30 is a circular substrate on which a wiring is printed. The four protrusions 31 are provided at a periphery of the circuit board 30, and are to be fitted into the openings 210 provided in the holder 2. A pair of depressions 33*a* and a pair of depressions 33*b* are formed at the periphery of the circuit board 30 so as to oppose each other. The pairs of depressions 33*a* and 33*b* are provided to lock the pairs of lead wires 11 and 12. Furthermore, a pair of connection pins 32*a* and a pair of connection pins 32*b* which are made of a conductive material are provided near the periphery of the circuit board 30 so as to oppose each other. The pairs of connection pins 32*a* and 32*b* are respectively provided in the vicinity of the pairs of depressions 33*a* and 33*b*. The pairs of lead wires 11 and 12 are respectively locked by the pairs of depressions 33*a* and 33*b*, and then respectively wound around the pairs of connection pins 32*a* and 32*b*. Thus, power output from the drive circuit unit 3 can be supplied with the spiral arc tube 1. Note that the connection pins 32*a* and 32*b* may be formed by wire-like components which are easily bent. If such is the case, the pairs of connection pins 32*a* and 32*b* are respectively twisted with the pairs of lead wires 11 and 12.

The case 4 is made of a resin, and formed like a cup. An E-shaped cap 41 is provided on a bottom surface of the case 4. The two openings 42 (only one of them is shown in FIG. 2) are formed in an inner surface of the case 4 in the vicinity of an open end of the case 4. The holder 2 is inserted into the case 4 so that the drive circuit unit 3 faces the case 4. Here, the protrusions 211 of the holder 2 are fitted into the openings 42 of the case 4, so that the holder 2 is fixed to the case 4.

(Construction of the Circuit Board 30)

The following part first describes a construction of a conventional circuit board 300 (shown in FIG. 3), and then a construction of the circuit board 30 relating to the first embodiment.

Figure 3:
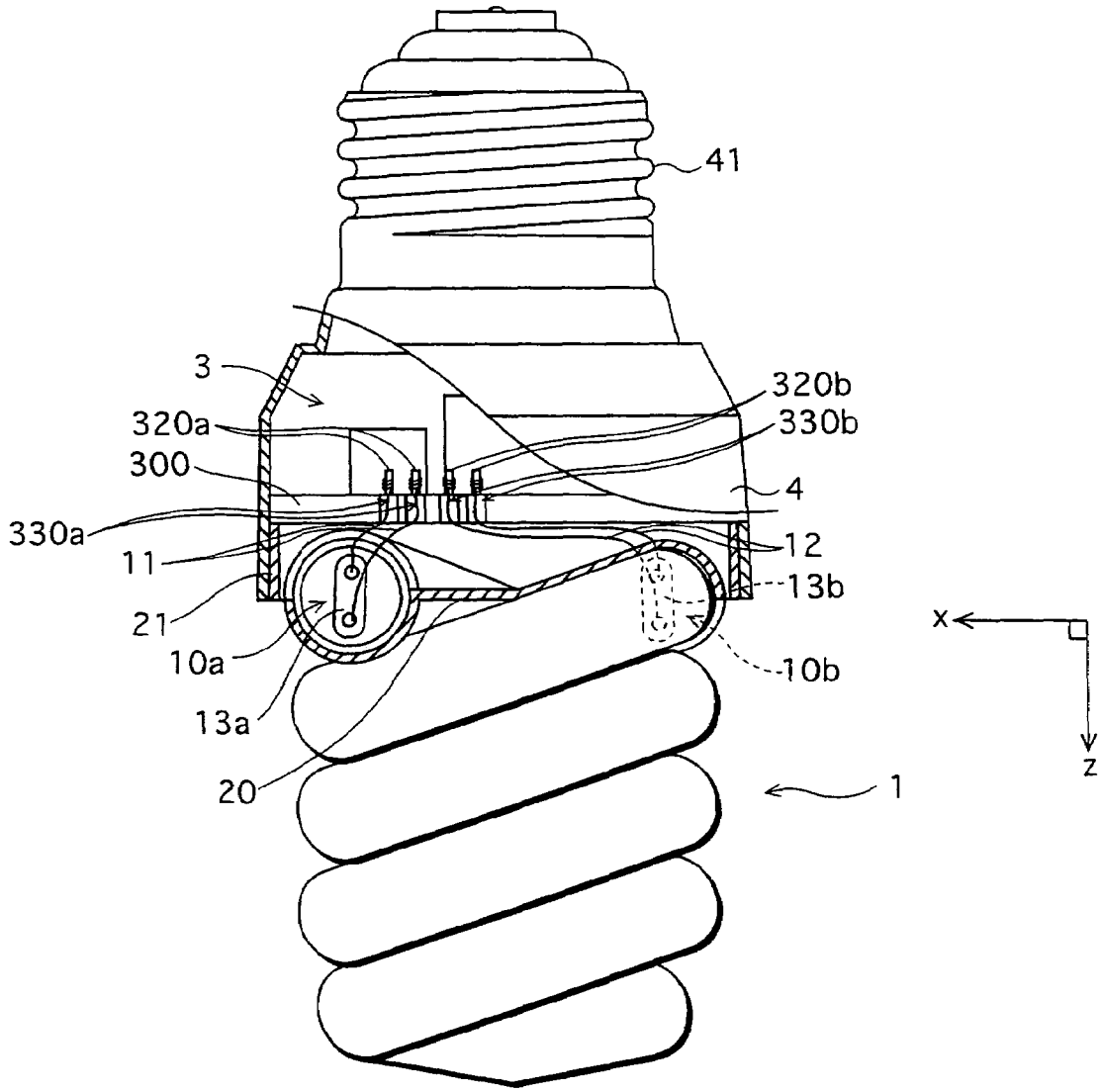
FIG. 3 is a front view illustrating a compact self-ballasted fluorescent lamp based on a conventional technique and shows an inner structure by removing a part of the lamp.

FIG. 3 is a front view illustrating a compact self-ballasted fluorescent lamp including the conventional circuit board 300 and shows an inner structure by removing part of the lamp. The compact self-ballasted fluorescent lamp shown in FIG. 3 has the same construction as the compact self-ballasted fluorescent lamp shown in FIGS. 1A, 1B and 2, except for locations of connection pins 320*a* and 320*b* and depressions 330*a* and 330*b* on the circuit board 300. The rest of the constituents are the same, and identified by the same reference numerals as in FIGS. 1A, 1B and 2. The same constituents are not repeatedly described in the following.

As shown in FIG. 3, the four depressions 330*a* and 330*b* are provided in line at the periphery of the circuit board 300. In addition, the four connection pins 320*a* and 320*b* are provided in line on the circuit board 300 in the vicinity of the depressions 330*a* and 330*b*. In other words, the connection pins 320*a* and 320*b* are conventionally aligned in line on the circuit board 300 to reduce a size of the circuit board 300. To be specific, since the connection pins 320*a* and 320*b* can be positioned near a capacitor, unnecessary wirings on the circuit board 300 can be eliminated, and the size of the circuit board 300 can be therefore reduced.

Here, it is assumed that the compact self-ballasted fluorescent lamp shown in FIG. 3 includes a conventional arc tube that has leg portions. Which is to say, end portions of the arc tube are not spirally wound in the spiral direction, but kept straight vertically (or straight in a direction along a height of the arc tube). If such is the case, the lead wires 11 and 12 are bent twice, at most, to be connected to the connection pins 320*a* and 320*b* on the circuit board 300. In detail, since the pairs of lead wires 11 and 12 respectively extend vertically from the end portions of the arc tube, the pairs of lead wires 11 and 12 are respectively bent horizontally (the first bending) to reach immediately below the pairs of connection pins 320*a* and 320*b*. In addition, the pairs of lead wires 11 and 12 are respectively bent vertically (the second bending) to be wound around the pairs of connection pins 320*a* and 320*b* located immediately above.

In the case of the spiral arc tube 1, however, the end portions 10*a* and 10*b* are spirally wound in the spiral direction as shown in FIG. 3. Therefore, the pairs of lead wires 11 and 12 respectively extend from the end portions 10*a* and 10*b* in the spiral direction as seen from FIG. 3. Here, the connection pins 320*a* and 320*b* are aligned in line as shown in FIG. 3. Thus, the lead wires 12 extending from the end portion 10*b* need to be bent towards the circuit board 300 (in the z-axis direction) (the first bending), bent horizontally (in an x-axis direction to reach immediately below the connection pins 320*b* (the second bending), and finally bent upwards vertically (in the z-axis direction) to be wound around the connection pins 320*b* (the third bending). As seen from the above description, the lead wires 11 and 12 need to be bent at a larger number of times at three to be connected to the circuit board 300, when using the spiral arc tube 1 together with the conventional circuit board 300 than when using the conventional arc tube having the leg portions with the conventional circuit board 300. However, the lead wires 11 and 12 which are thin wires are very fragile because of, for example, heating conducted for creating the sealing portions 13*a* and 13*b* in the spiral arc tube 1. Specifically speaking, if bent five to six times, the lead wires 11 and 12 will break. Furthermore, to bend the lead wires 11 and 12 as describe above, a step of bending the leading wires 11 and 12 is required in an assembly process of the compact self-ballasted fluorescent lamp. If the lead wires 11 and 12 need to be bent at a larger number of times, a larger number of bending steps are required. This results in a high manufacturing cost of the compact self-ballasted fluorescent lamp. In addition, the lead wires 12 need to extend longer from the end portion 10*b* when the spiral arc tube 1 is used than when the conventional arc tube having leg portions is used. This may cause the lead wires 12 to contact with each other, which causes short circuit.

Given these problems, in the compact self-ballasted fluorescent lamp including the spiral arc tube 1 relating to the first embodiment of the present invention as shown in FIGS. 1A, 1B and 2, the pairs of connection pins 32*a* and 32*b* are respectively positioned on the circuit board 30 so as to be, to a large extent, directly above (in the vicinity of) the end portions 10*a* and 10*b* of the spiral arc tube 1. In other words, the pairs of connection pins 32*a* and 32*b* are formed near the periphery of the circuit board 30 so as to oppose each other.

Figure 4A:
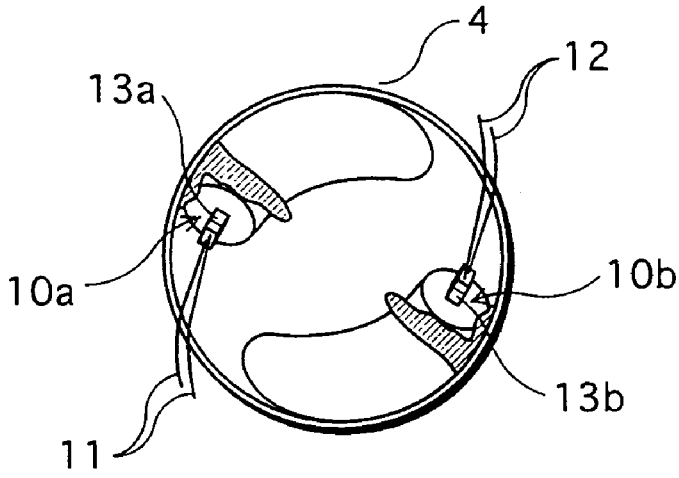
FIG. 4 includes a plan view illustrating how a spiral arc tube is fixed to a case, and a view illustrating a cross-section of part of the spiral arc tube fixed to the case.
Figure 4B:
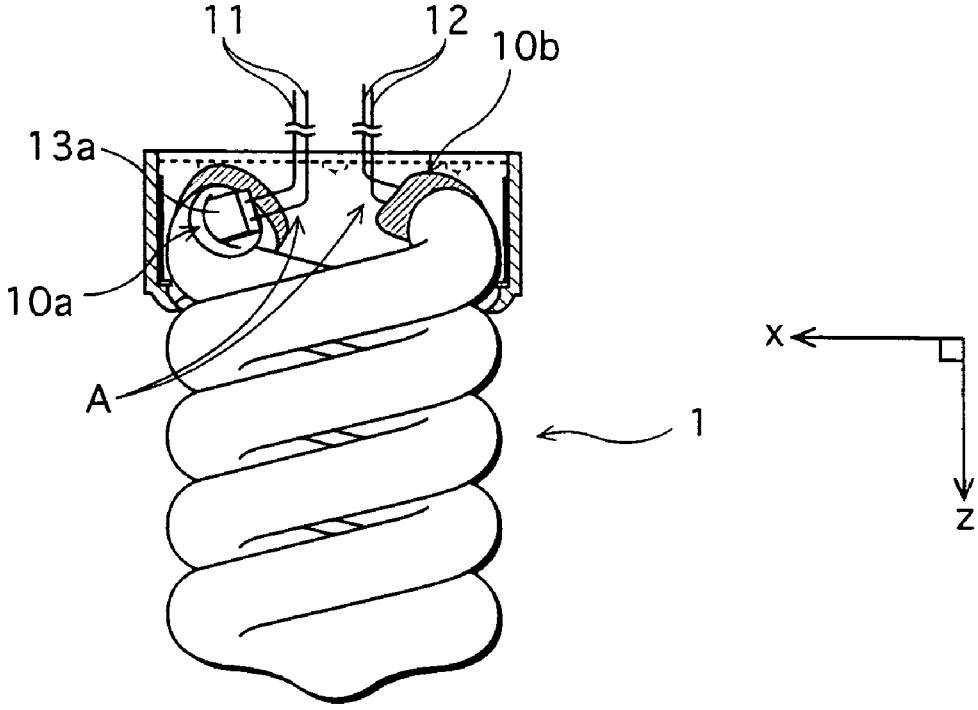

FIG. 4 is a schematic view illustrating how the spiral arc tube 1 relating to the first embodiment is attached to the holder 2, where FIG. 4A is a plan view and FIG. 4B is a side view. It should be noted that the case 4 and some other constituents are not illustrated in FIG. 4.

According to the first embodiment, the pairs of connection pins 32*a* and 32*b* (shown in FIGS. 1A, 1B and 2) are respectively provided in the vicinity of the end portions 10*a* and 10*b* of the spiral arc tube 1 as described above. Thus, if bent once towards the pairs of connection pins 32*a* and 32*b* (shown in FIGS. 1A and 1B), i.e. in the z-axis direction, the pairs of lead wires 11 and 12 are respectively locked by the pairs of depressions 33*a* and 33*b*, to be wound around the pairs of connection pins 32*a* and 32*b* as shown in FIG. 4B. In other words, the pairs of connection pins 32*a* and 32*b* (shown in FIGS. 1A, 1B and 2) are respectively positioned at the possibly shortest distance from the end portions 10*a* and 10*b* of the spiral arc tube 1. To be wound around the pairs of connection pins 32*a* and 32*b* (shown in FIGS. 1A, 1B and 2) respectively, the pairs of lead wires 11 and 12 need to be bent only once at bending portions A to extend upwards substantially vertically (as shown in FIGS. 1A, 1B and 4B). Which is to say, the lead wires 11 and 12 do not need to be bent as many times as required to connect the lead wires 11 and 12 to the conventional circuit board 300.

As described above, the lead wires 11 and 12 are bent at a fewer times in the compact self-ballasted fluorescent lamp relating to the first embodiment than in the compact self-ballasted fluorescent lamp including the conventional circuit board 300. As a result, the lead wires 11 and 12 are less likely to break according to the first embodiment. In addition, the number of steps in the assembly process of the compact self-ballasted fluorescent lamp is reduced. Furthermore, since the lead wires 11 and 12 can be shortened, a short circuit due to a contact between the lead wires 11 or 12 is less likely to occur. This makes it unnecessary to apply an insulating material onto the lead wires 11 and 12.

As shown in FIG. 4B, the pairs of lead wires 11 and 12 respectively extend from the end portions 10*a* and 10*b*, and are bent at a substantially right angle, at the bending portions A before being connected to the pairs of connection pins 32*a* and 32*b*. This produces an elasticity in the lead wires 11 and 12. Accordingly, the lead wires 11 and 12 do not break easily when wound around the pairs of connection pins 32*a* and 32*b* (shown in FIGS. 1A, 1B and 2). Furthermore, when the connection pins 32*a* and 32*b* (shown in FIGS. 1A, 1B and 2) are formed by wire-like components, the pairs of connection pins 32*a* and 32*b* are twisted together with the pairs of the lead wires 11 and 12 by using a pair of tweezers or the like. In this case, the elasticity produced in the lead wires 11 and 12 can absorb a stress generated when the lead wires 11 and 12 are twisted together with the connection pins 32*a* and 32*b*. Thus, the stress is less likely to be transmitted to the sealing portions 13*a* and 13*b*. This reduces breakage of the sealing portions 13*a* and 13*b*.

In the above description, the first embodiment is, as an example, applied to a compact self-ballasted fluorescent lamp with no globe. However, the first embodiment is applicable to a compact self-ballasted fluorescent lamp in which a globe mantles a spiral arc tube.

(Modification Example)

According to the first embodiment, the pairs of lead wires 11 and 12 respectively extend from the end portions 10*a* and 10*b* horizontally, and are then bent upwards in the z-axis direction at the bending portions A as shown in FIG. 4B. However, the pairs of lead wires 11 and 12 may respectively extend downwards from the end portions 10*a* and 10*b* in the z-axis direction, and are then bent upwards in the z-axis direction.

Figure 5A:
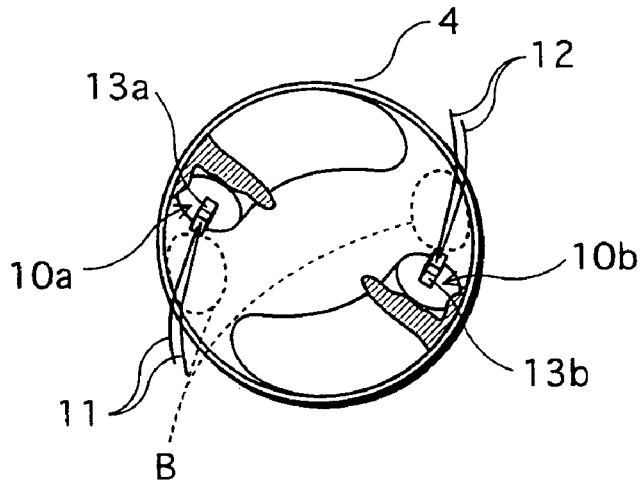
FIG. 5 includes a plan view illustrating how a spiral arc tube is fixed to a case, and a view illustrating a cross-section of part of the spiral arc tube fixed to the case.
Figure 5B:
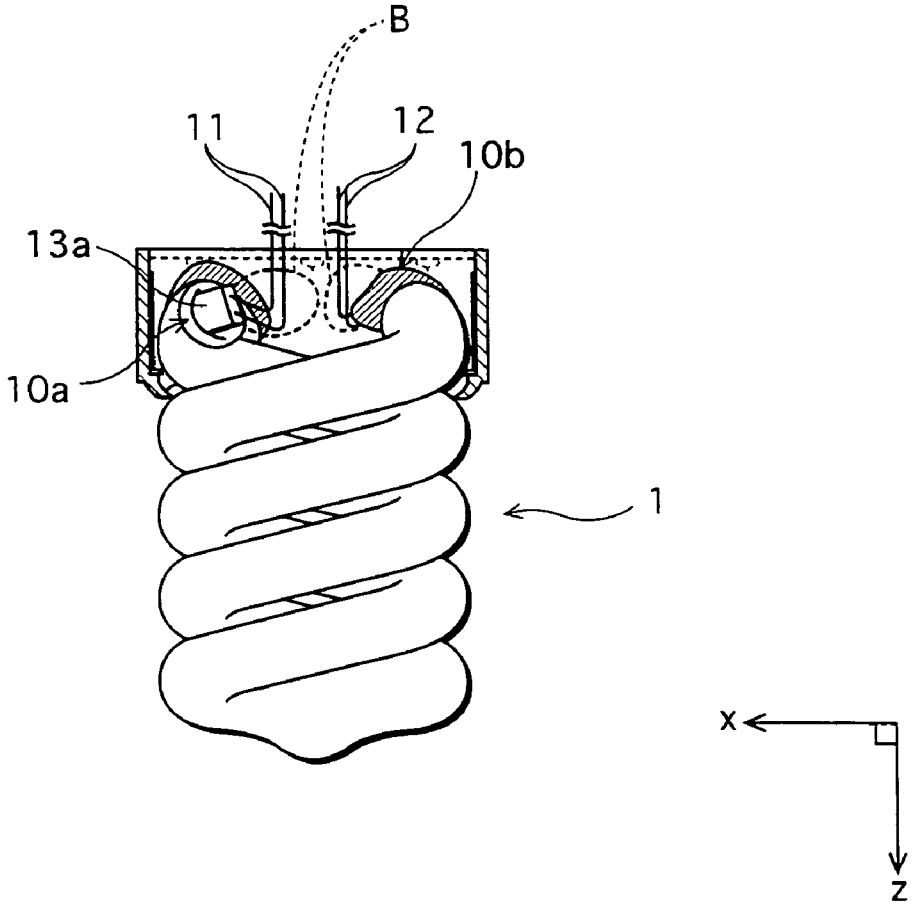
Figure 6A:
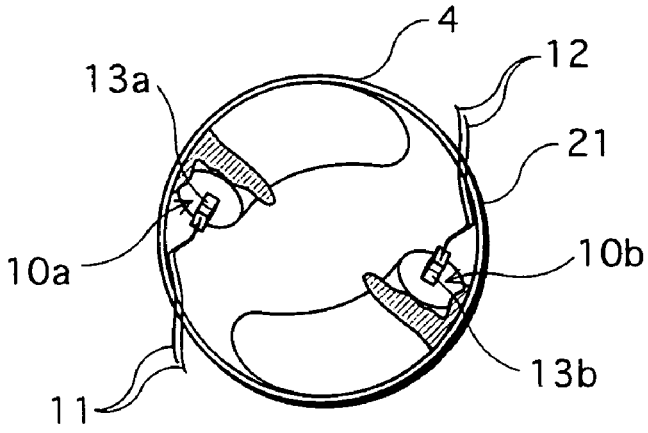
FIG. 6 includes a plan view illustrating how a spiral arc tube is fixed to a case, and a view illustrating a cross-section of part of the spiral arc tube fixed to the case.
Figure 6B:
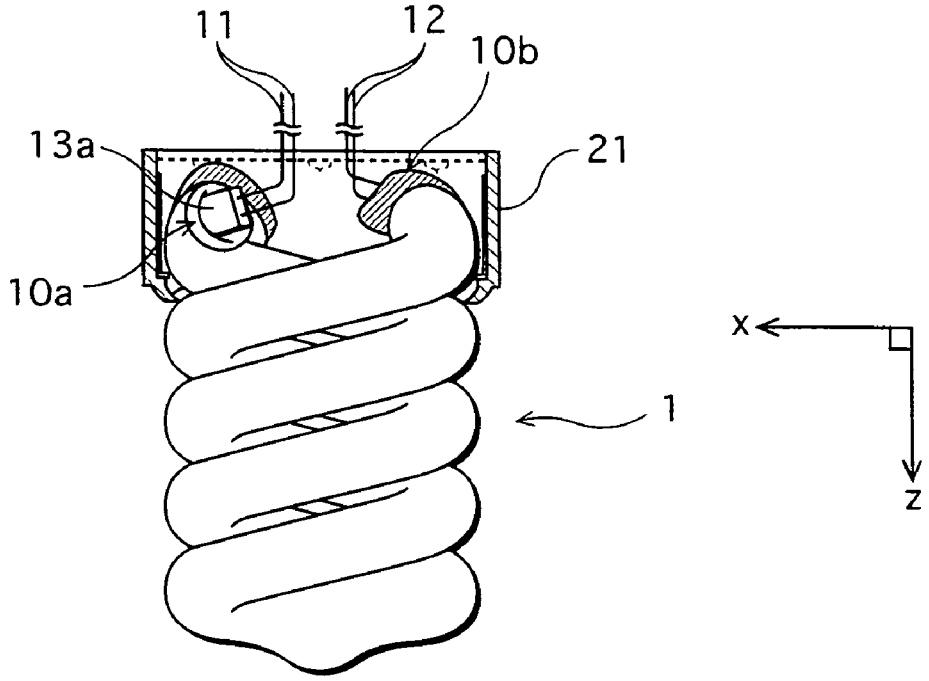

FIG. 5 is a schematic view illustrating how a spiral arc tube relating to a modification example of the first embodiment is attached to the holder 2, where FIG. 5A is a plan view, and FIG. 5B is a side view. In FIG. 5, the case 4 and some other constituents are not illustrated.

As shown in FIG. 5B, since the pairs of lead wires 11 and 12 respectively extend downwards from the end portions 10*a* and 10*b* in the z-axis direction, bending portions of the lead wires 11 and 12 are positioned sufficiently distant from the circuit board 30 (shown in FIG. 1A). This means that the lead wires 11 and 12 are positioned distant from the circuit board 30. Thus, occurrence of a short circuit between the circuit board 30 and the lead wires 11 and 12 can be reduced.

The pairs of lead wires 11 and 12 may be fixed to the holder 2 using an insulating resin at areas B within dashed circles in FIGS. 5A and 5B. Here, the areas B are where the lead wires 11 and 12 are bent. The lead wires 11 are fixed to the holder 2 so as to be separated from each other, and the same holds true to the lead wires 12. This prevents a short circuit between the lead wires 11 and between the lead wires 12. In addition, the fixing by means of the insulating resin absorbs a tension generated when the lead wires 11 and 12 are wound around the connection pins 32*a* and 32*b*. Since the tension is not transmitted to the sealing portions 13*a* and 13*b*, breakage of the sealing portions 13*a* and 13*b* is reduced.

Alternatively, the pairs of lead wires 11 and 12 respectively extending from the end portions 10*a* and 10*b* may be first bent towards the wall 21 so as to run along an inner surface of the wall 21 of the holder 2. Thus, the pairs of lead wires 11 and 12 respectively reach the vicinity of the pairs of connection pins 32*a* and 32*b*, and are then bent upwards in the z-axis direction. Thus, since the lead wires 11 and 12 are positioned sufficiently distant from the circuit board 30 (shown in FIG. 1A), a short circuit between the circuit board 30 and the lead wires 11 and 12 is less likely to occur. Here, such a short circuit is caused because a terminal of a circuit element is exposed on a back surface of the circuit board 30 (shown in FIG. 1A). When the conventional technique is used, the lead wires 11 and 12 tend to be in contact with the circuit board 30, and a short circuit is therefore highly likely to occur. However, the above-described construction reduces occurrence of a short circuit.

Since the bending portions produce an elasticity in the lead wires 11 and 12, the breakage of the sealing portions 13*a* and 13*b* can be reduced for the same reasons stated above.

Figure 7A:
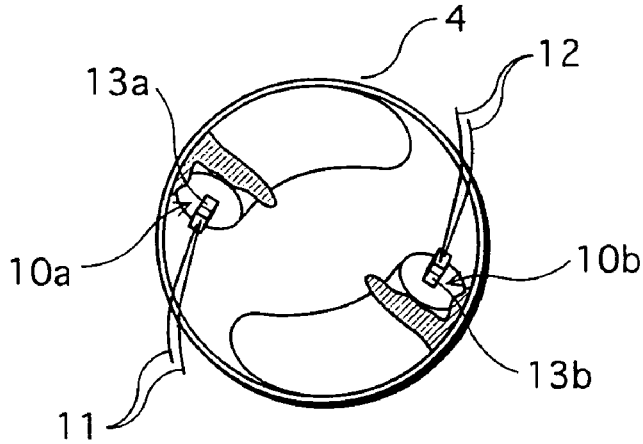
FIG. 7 includes a plan view illustrating how a spiral arc tube is fixed to a case, and a view illustrating a cross-section of part of the spiral arc tube fixed to the case.
Figure 7B:
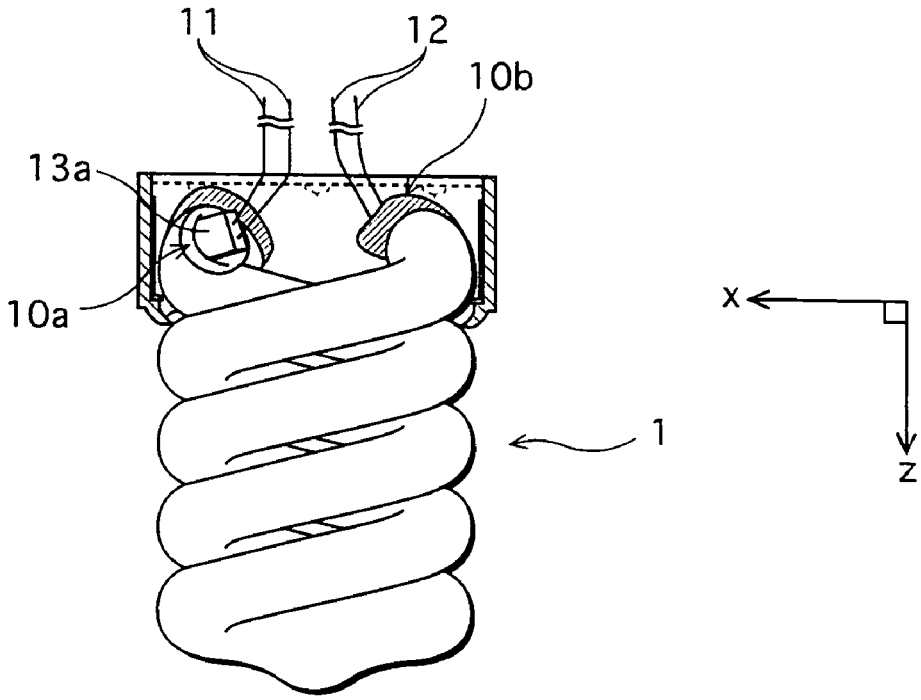

If the end portions 10*a* and 10*b* are respectively positioned in the vicinity of the pairs of connection pins 32*a* and 32*b* on the circuit board 30 (shown in FIG. 2), the pairs of lead wires 11 and 12 may be respectively connected to the pairs of connection pins 32*a* and 32*b* without being bent, as shown in FIG. 7. Therefore, occurrence of a short circuit can be reduced when compared with the compact self-ballasted fluorescent lamp shown in FIG. 3. Furthermore, since the number of times the lead wires 11 and 12 are bent is reduced, the breakage of the lead wires 11 and 12 can be reduced.

Second Embodiment

According to the first embodiment, the pairs of connection pins 32*a* and 32*b* are respectively positioned in the vicinity of the end portions 10*a* and 10*b* of the spiral arc tube 1 in order to prevent a short circuit between the lead wires 11 or between the lead wires 12. A second embodiment aims to prevent a short circuit between lead wires without changing a conventional location of connection pins on a circuit board.

(Construction of Compact Self-Ballasted Fluorescent Lamp)

Figure 8A:
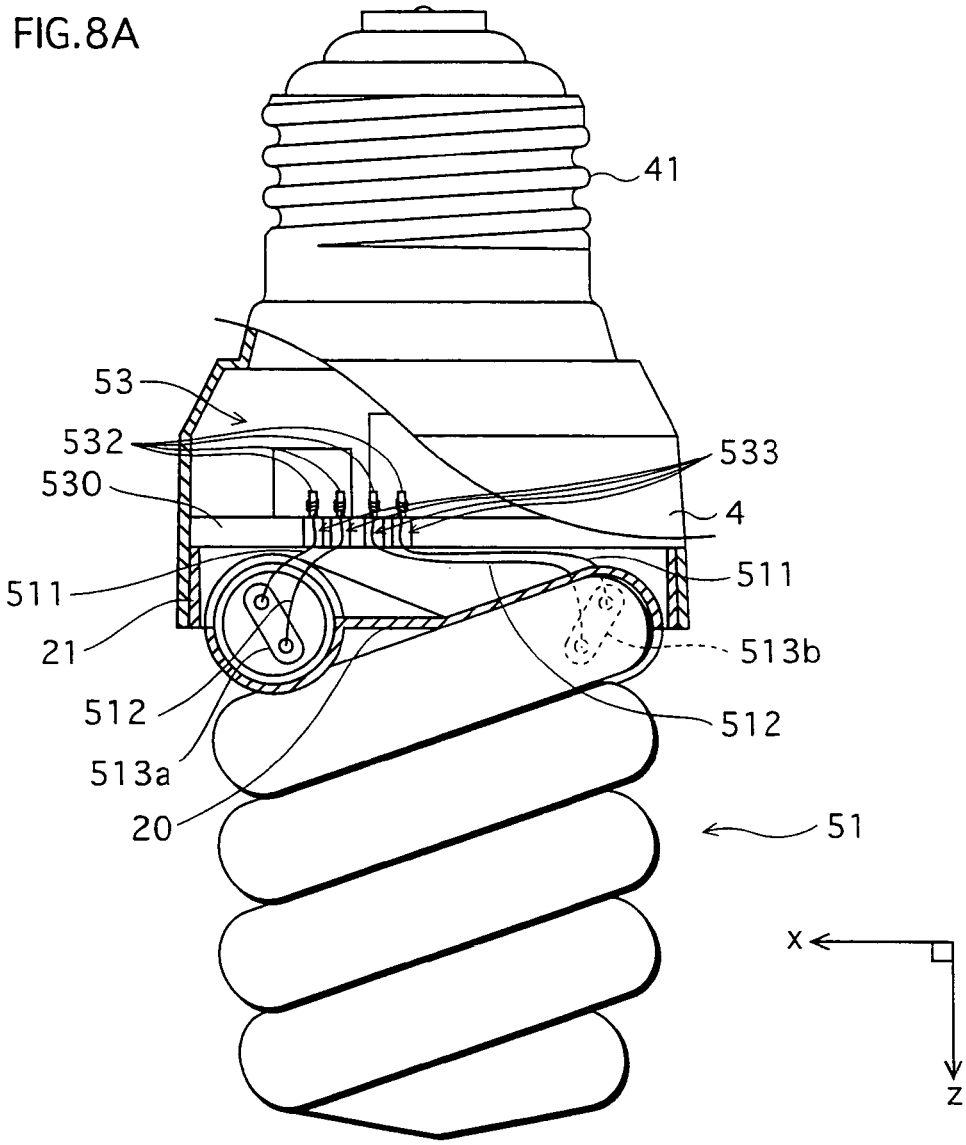
FIG. 8 is a front view illustrating a compact self-ballasted fluorescent lamp relating to a second embodiment, and shows an inner structure by removing a part of the lamp.
Figure 8B:
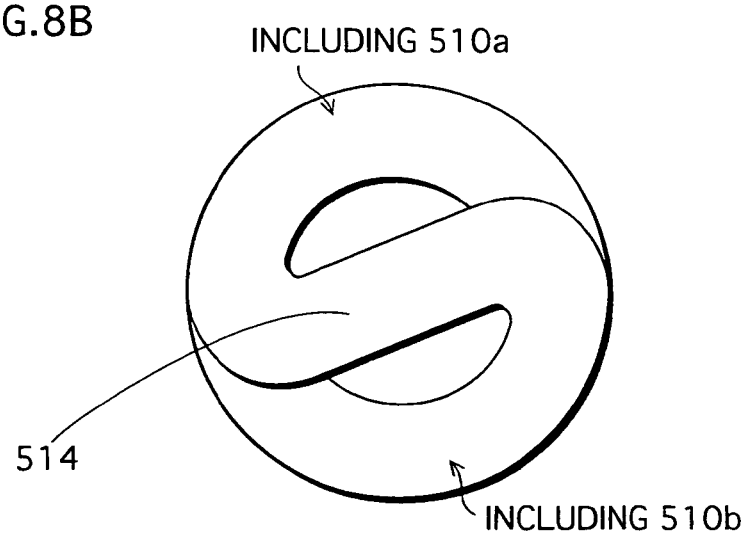
Figure 9:
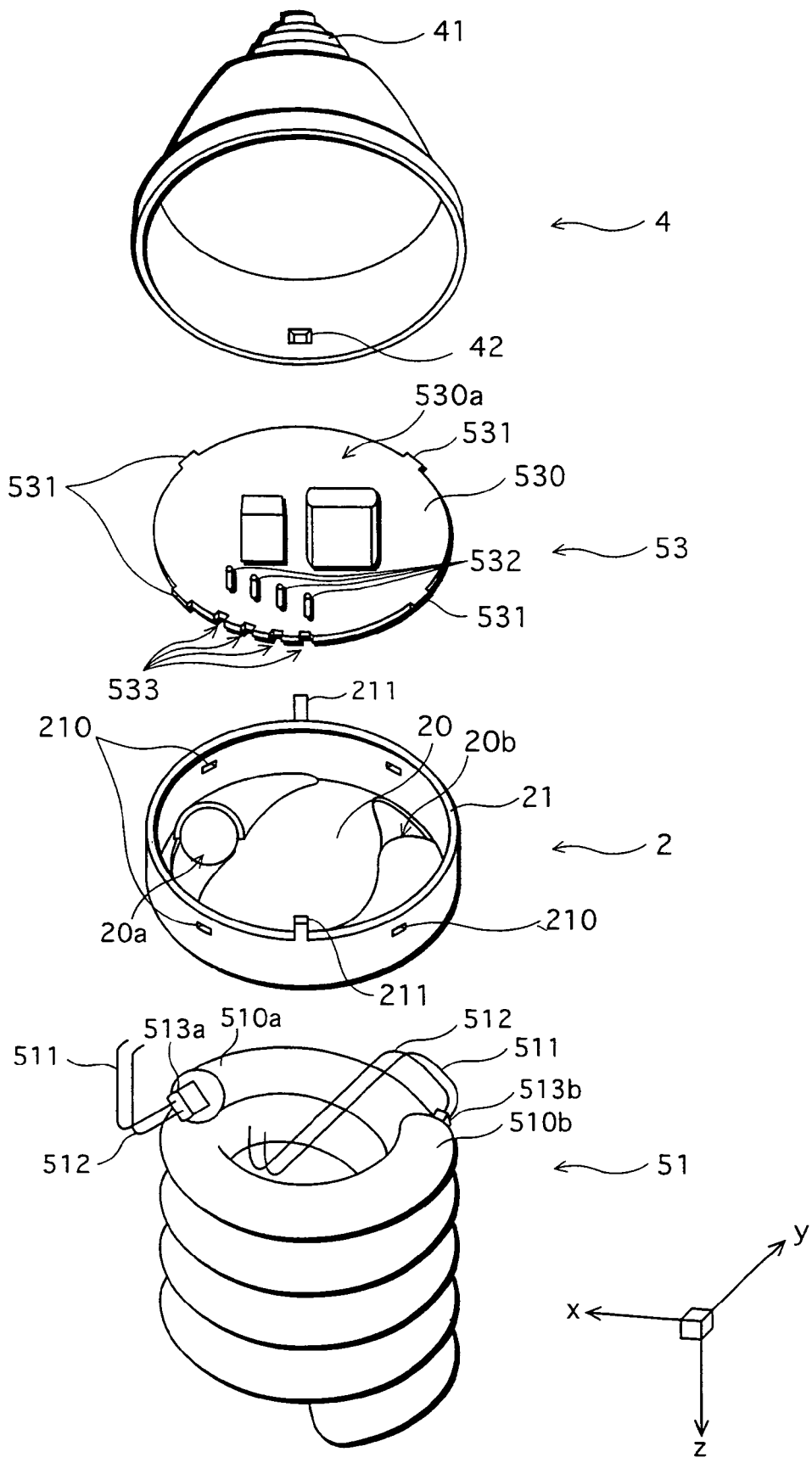
FIG. 9 is a perspective exploded view illustrating the compact self-ballasted fluorescent lamp relating to the second embodiment.

The following describes a construction of a compact self ballasted fluorescent lamp relating to the second embodiment. FIG. 8A is a front view illustrating the compact self-ballasted fluorescent lamp relating to the second embodiment and shows an inner structure by removing part of the lamp, and FIG. 8B is a bottom plan view of a spiral arc tube 51. FIG. 9 is an exploded view illustrating the compact self-ballasted fluorescent lamp relating to the second embodiment. The compact self-ballasted fluorescent lamp relating to the second embodiment has the same construction as the compact self-ballasted fluorescent lamp relating to the first embodiment shown in FIGS. 1A, 1B and 2 except for the following features. In the compact self-ballasted fluorescent lamp relating to the second embodiment, sealing portions 513*a* and 513*b* of the spiral arc tube 51 are tilted, and connection pins 532 are differently positioned on a circuit board 530. The rest of the constituents are the same as in the first embodiment, and identified by the same reference numerals as used in FIGS. 1A, 1B and 2.

As shown in FIGS. 8A, 8B and 9, the compact self-ballasted fluorescent lamp relating to the second embodiment includes the spiral arc tube 51 that emits light, the holder 2 to which the spiral arc tube 51 is fixed, a drive circuit unit 53 that includes a circuit board 530 on which circuit units are provided to cause the spiral arc tube 51 to emit light, and the case 4 which houses the drive circuit unit 53 and to which the holder 2 is fixed.

The spiral arc tube 51 is formed by bending a glass tube. Here, a phosphor is applied on a tube inner surface of the glass tube as in the first embodiment. The spiral arc tube 51 has a double spiral configuration. In detail, the glass tube is spirally wound from a middle portion to both end portions inclusive. A pair of electrically conductive lead wires extends from each end portion, and supports an electrode at each end portion. As shown in FIG. 8B, the middle portion of the glass tube corresponds to a linear connection portion 514 of the spiral arc tube 51. The spiral arc tube 51 has a double spiral configuration which is formed in such a manner that the spirally wound glass tube is turned at the connection portion 514 corresponding to the middle portion.

In each of end portions 510*a* and 510*b* of the spiral arc tube 51, a filament (not shown) is provided. A pair of a lead wire 511 and a lead wire 512 extends from each of the end portions 510*a* and 510*b*, and is sealed and fixed by each of sealing portions 513*a* and 513*b*. The sealing portions 513*a* and 513*b* are formed by melting and pinching corresponding portions of the glass tube.

To be wound around connection pins 532 on the circuit board 530, the lead wires 511 and 512 fixed to the sealing portion 513*a* are pulled upwards in a direction substantially parallel to the z-axis direction as shown in FIG. 8A. On the other hand, the lead wires 511 and 512 fixed to the sealing portion 513*b* extend upwards in the z-axis direction from the end portion 510*b* as shown in FIG. 8A, are bent in the x-axis direction, which is perpendicular to the z-axis direction, and then bent again in the z-axis direction to be wound around the connection pins 532.

The drive circuit unit 53 is formed in such a manner that a drive unit 530*a* is provided on the circuit board 530. The drive unit 530*a* includes a transistor and a capacitor to drive the spiral arc tube 51, as in the first embodiment.

The circuit board 530 is a circular substrate on which a wiring is printed. Four protrusions 531 are provided at a periphery of the circuit board 530, and are to be fitted into the openings 210 provided in the holder 2. Four depressions 533 are aligned at the periphery of the circuit board 530. The depressions 533 are provided to lock the lead wires 511 and 512. Four connection pins 532 made of a conductive material are provided in line on the circuit board 530 in the vicinity of the depressions 533. The lead wires 511 and 512 are locked in the depressions 533, and then wound around the connection pins 532. Thus, power output from the drive circuit unit 53 can be supplied with the spiral arc tube 51.

(Construction of the Spiral Arc Tube 51)

Figure 10:
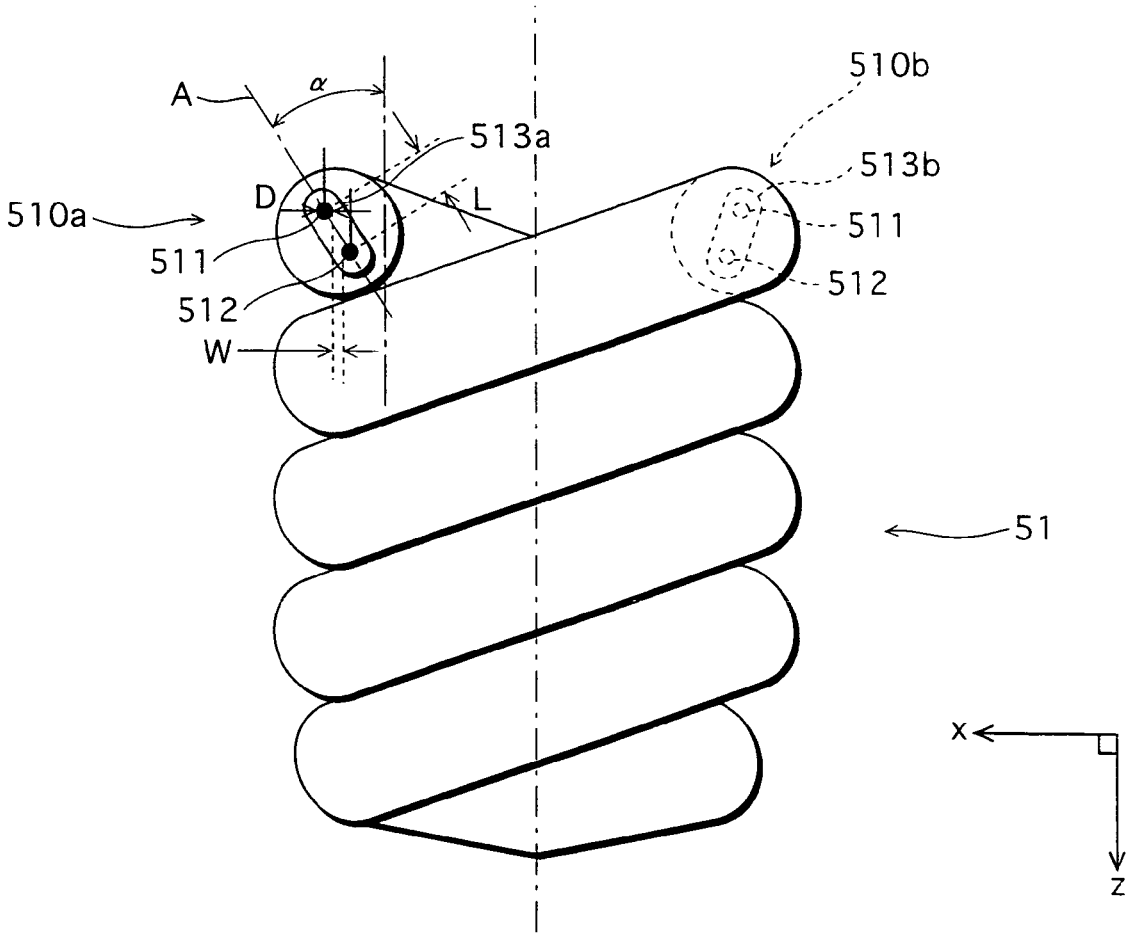
FIG. 10 is a front view illustrating a spiral arc tube.

The following part describes a construction of the spiral arc tube 51 relating to the second embodiment, with reference to FIG. 10.

FIG. 10 is a front view illustrating the spiral arc tube 51.

As shown in FIG. 10, an interval is provided, in the x-axis direction, between the lead wires 511 and 512 extending from each of the end portions 510*a* and 510*b*, in the spiral arc tube 51 relating to the second embodiment. Thus, the lead wires 511 and 512 do not overlap each other in the z-axis direction. This construction is described in more detail in the following. In the pair of the lead wires 511 and 512 fixed by each of the sealing portions 513*a* and 513*b*, the lead wire 511 is positioned closer, than the lead wire 512 is, to the circuit board 530, and positioned more distant, than the lead wire 512 is, from a spiral axis of the spiral arc tube 51, where the spiral axis extends in the z-axis direction.

The following part describes how to achieve this construction. In the end portion 510*a*, the lead wire 511 is located above the lead wire 512. Here, a line A connecting cross-sectional centers of the lead wire 511 and the lead wire 512 is tilted by an angle of a degrees with respect to the z-axis direction. A value of $\alpha$ is determined taking into consideration a thickness of each of the lead wires 511 and 512 and the like. For example, the value of $\alpha$ can be determined so as to satisfy a formula $L_{sin}\alpha - D > 0$, when D represents the thickness of each of the lead wires 511 and 512, and L represents a distance between the cross-sectional centers of the lead wires 511 and 512. If this condition is satisfied, in each of the end portions 510*a* and 510*b*, an interval having a length of W is provided between the lead wires 511 and 512 in the x-axis direction, so that the lead wires 511 and 512 do not overlap each other in the z-axis direction.

Here, it is assumed that the lead wire 512 is positioned directly below the lead wire 511 (i.e. $\alpha=0$) in each of the end portions 510*a* and 510*b*. In this case, if the lead wire 512 is pulled upwards to be wound around a corresponding one of the connection pins 532 as shown in FIG. 8A, the lead wires 511 and 512 overlap each other in the z-axis direction. This tends to cause a short circuit to occur.

According to the second embodiment, however, the interval having a length of W is provided, in the x-axis direction, between the lead wires 511 and 512 extending from each of the end portion 510*a* and 510*b*. Therefore, even if the lead wires 511 and 512 are pulled upwards in the z-axis direction to be wound around the connection pins 532, the lead wires 511 and 512 are less likely to be in contact with each other. This reduces occurrence of a short circuit, and makes it unnecessary to apply an insulating material onto the lead wires 511 and 512.

As the lead wires 511 and 512 are fixed to each of the sealing portions 513*a* and 513*b* by pinching as described later, the lead wire 512 is preferably positioned closer to the spiral axis of the spiral arc tube 51, in a direction along a spiral diameter of the spiral arc tube 51, when compared with the lead wire 511.

(How to Fix the Lead Wires 511 and 512 by Pinching)

The following part describes how to seal and fix the pairs of lead wires 511 and 512 to the spiral arc tube 51 relating to the second embodiment.

Figure 11A:
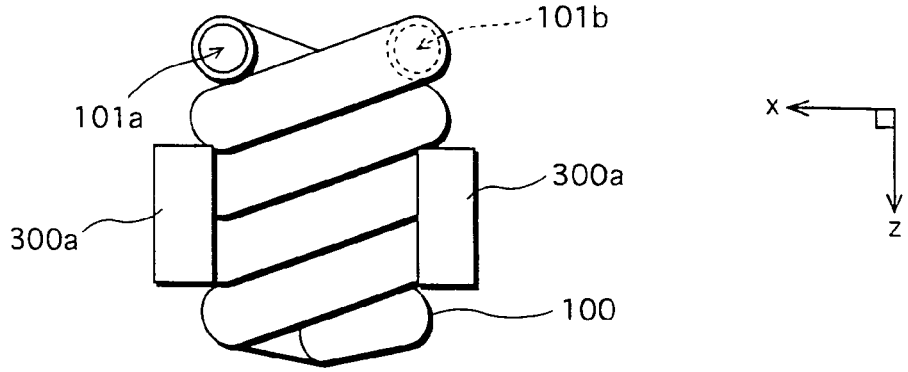
FIG. 11 illustrates a sealing step of the spiral arc tube.
Figure 11B:
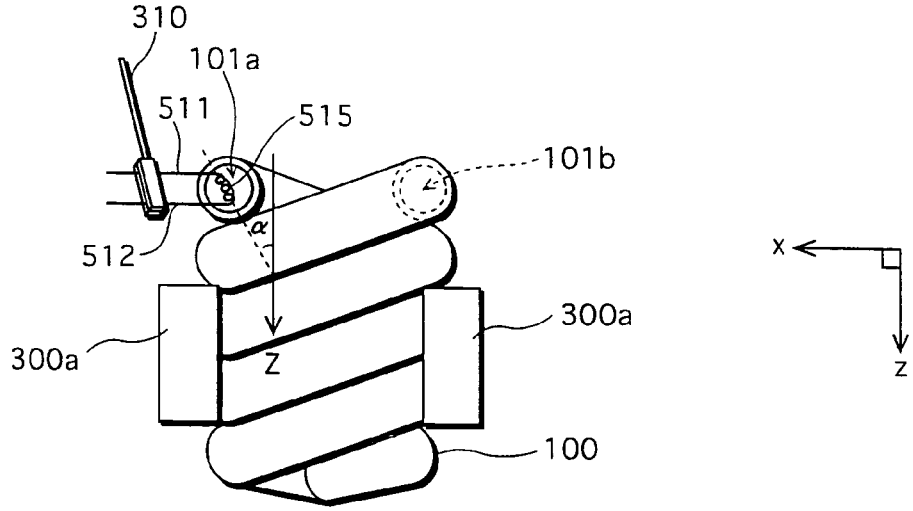
Figure 11C:
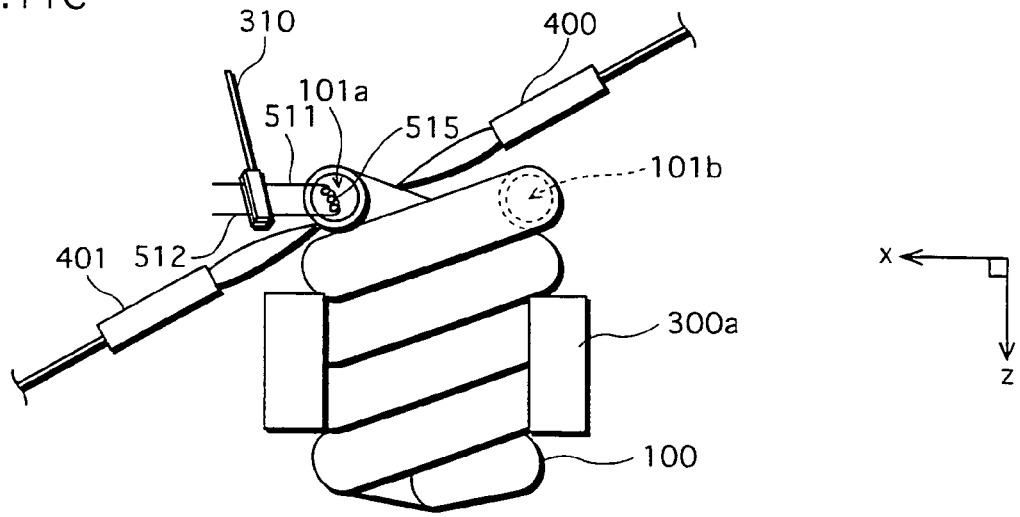
Figure 12D:
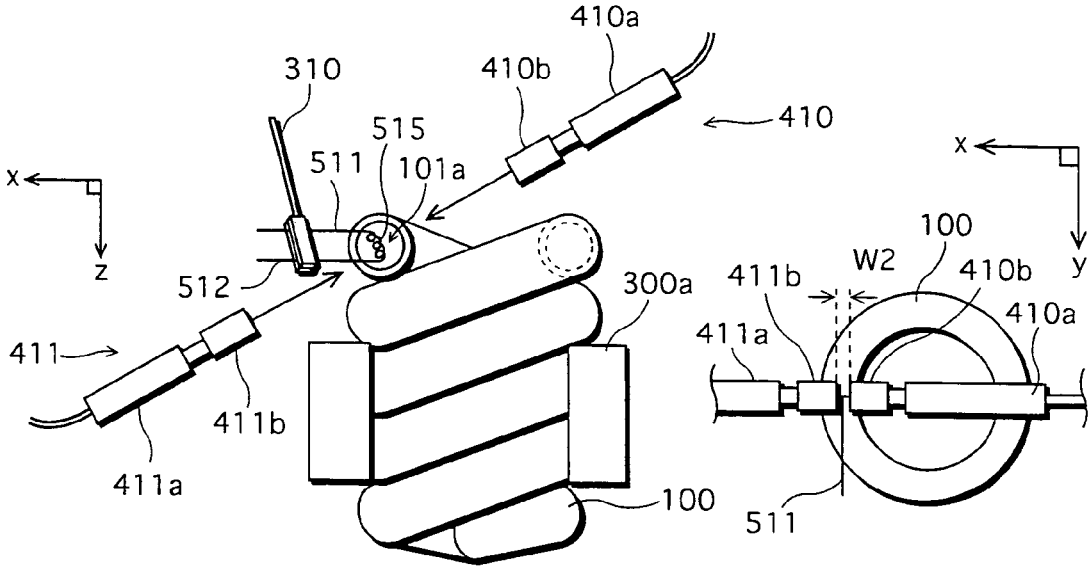
FIG. 12 illustrates a sealing step of the spiral arc tube.
Figure 12E:
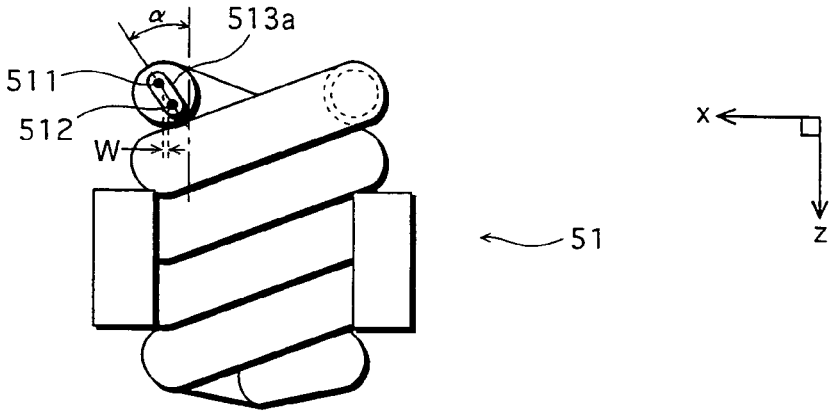

FIGS. 11 and 12 each illustrate a process to fix the pairs of lead wires 511 and 512 to the spiral arc tube 51. The fixing process proceeds in the order of steps respectively shown in FIGS. 11A to 12E.

Firstly, as shown in FIG. 11A, an arc tube 100 which has a spiral configuration and an opening 101*a* and an opening 101*b* respectively at its ends is held by a clamp 300*a*.

After this, as shown in FIG. 11B, a filament 515 is prepared. Here, one end of the filament 515 is connected to an end of the lead wire 511, and the other end of the filament 515 is connected to an end of the lead wire 512, so that the filament 515 and the lead wires 511 and 522 are squarely U-shaped as a whole. By holding the lead wires 511 and 512 using a clamp 310, the filament 515 is inserted into the arc tube 100 through the opening 101*a*. Here, the clamp 310 is adjusted so that the line connecting the cross-sectional centers of the lead wires 511 and 512 is tilted by the predetermined angle of $\alpha$ degrees with respect to the z-axis direction.

Next, as shown in FIG. 1C, a portion of the arc tube 100 in the vicinity of the opening 101*a* is heated to a temperature equal to or higher than a softening point of the arc tube 100 by means of point burners 400 and 401. The point burners 400 and 401 are each fixed to a supporting member (not illustrated), and positioned so as to oppose each other. Here, flame produced by each of the point burners 400 and 401 is preferably directed to the portion to be heated in a direction perpendicular to the line connecting the cross-sectional centers of the lead wires 511 and 512. In this way, the flame is directed to a part of the glass tube 100 which is preferably heated to a sufficiently high temperature because the part is to be pressed by pressing members.

Subsequently, as shown in FIG. 12D, the point burners 400 and 401 are replaced with press devices 410 and 411. The press devices 410 and 411 are positioned so as to oppose each other in the same positions as the point burners 400 and 401. The press device 410 has an actuator 410*a* and a brass press member 410*b*, and the press device 411 has an actuator 411*a* and a brass press member 411*b*. The press members 410*b* and 411*b* are respectively fixed at ends of the actuators 410*a* and 411*a*.

The actuators 410*a* and 411*a* are driven by application of air pressure, to expand and contract. When the actuators 410*a* and 411*a* expand, the press members 410*b* and 411*b* are pressed against a portion of the spiral arc tube 100 in the vicinity of the opening 101*a*. Here, a surface of each of the press members 410*b* and 411*b* which is pressed against the arc tube 100 is straight when seen from front. When pressed against the portion of the arc tube 100 in the vicinity of the opening 101*a*, the press members 410*b* and 411*b* oppose each other with an interval having a length of W2 being retained as shown in a plan view of FIG. 12D. In this way, the opening 101*a* is sealed, and the sealing portion 513*a* (having a width of W2) from which the lead wires 511 and 512 extend is formed.

Lastly, the arc tube 100 is gradually cooled down, to remove distortion within the arc tube 100. This reduces breakage of the arc tube 100 caused by a remaining pressure.

The same procedure as described above is performed for the opening 101*b*. Thus, the spiral arc tube 51 shown in FIG. 12E is obtained.

MODIFICATION EXAMPLE

According to the second embodiment, the surface of each of the press members 410*b* and 411*b* which is pressed against the arc tube 100 is straight when seen from front. However, the second embodiment is not limited to such. As an alternative, the surface of one of the press members 410*b* and 411*b* which is pressed against the arc tube 100 may be tilted by an angle of a degrees, when seen from front, with respect to the spiral axis of the arc tube 100. The surface of the other press member may be tilted by an angle of (180-$\alpha$) degrees, so as to correspond to the surface tilted by the angle of a degrees. In this case, the actuators 410*a* and 411*a* extend and contract along the x-axis direction. In this manner, a compact self-ballasted fluorescent lamp which achieves the effects of the second embodiment can be also obtained.

In the above description, the second embodiment is, as an example, applied to a compact self-ballasted fluorescent lamp with no globe. However, the second embodiment of the present invention is also applicable to a compact self-ballasted fluorescent lamp with a globe.

According to the second embodiment, the sealing portions 513*a* and 513*b* are each tilted by an angle with respect to the spiral axis of the spiral arc tube 51. Therefore, when the lead wires 511 and 512 extending from each of the end portions 510*a* and 510*b* are pulled upwards vertically, an interval is provided between the lead wires 511 and 512 in the x-axis direction. This prevents the lead wires 511 and 512 from overlapping each other. This effect can be also produced in the following manner. An end surface of each of the sealing portions 513*a* and 513*b* from which the pair of lead wires 511 and 512 extend may be tilted like a slope so that an interval is provided in the y-axis direction between the lead wires 511 and 512 extending from each of the sealing portions 513*a* and 513*b*. In more detail, the lead wire 512 is positioned closer to the end of each of the end portions 510*a* and 510*b* than the lead wire 512 is. In this way, when the lead wires 511 and 512 extend from each of the end portions 510*a* and 510*b* in the z-axis direction, the lead wires 511 and 512 are less likely to overlap each other, as in the second embodiment. This reduces occurrence of a short circuit.

Figure 13A:
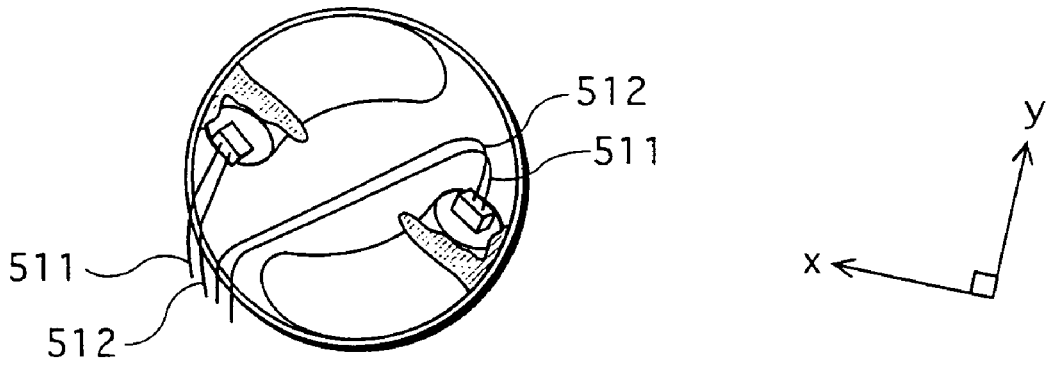
FIG. 13 includes a plan view illustrating how a spiral arc tube is fixed to a case, and a view illustrating a cross-section of part of the spiral arc tube fixed to the case.
Figure 13B:
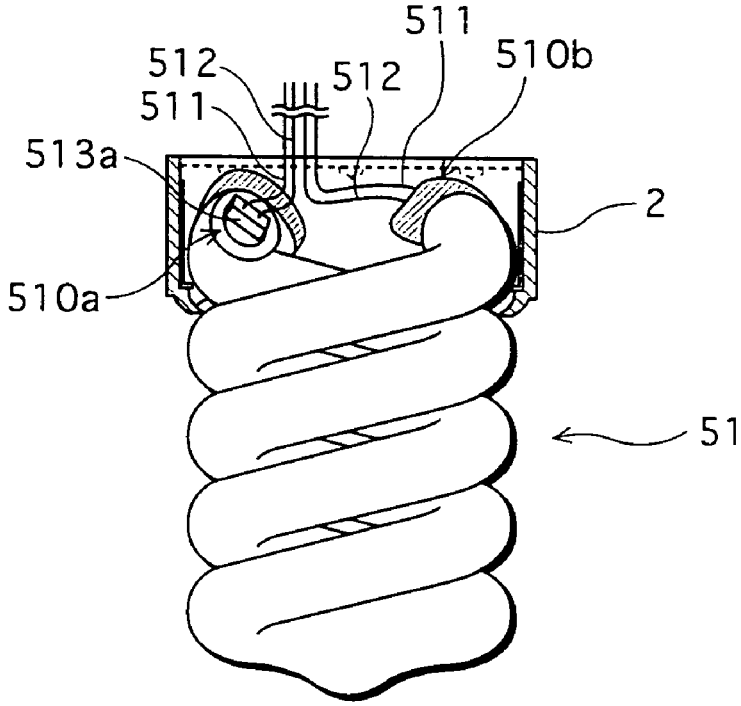

FIG. 13 is a schematic view illustrating how the spiral arc tube 51 relating to the second embodiment is attached to the holder 2, where FIG. 13A is a plan view, and FIG. 13B is a side view. The case 4 and some other constituents are not illustrated in FIG. 13.

As shown in FIGS. 13A and 13B, the lead wires 511 and 512 horizontally extend from each of the end portions 510*a* and 510*b* of the spiral arc tube 51 in the second embodiment, and are then bent upwards in the z-axis direction.

Figure 14A:
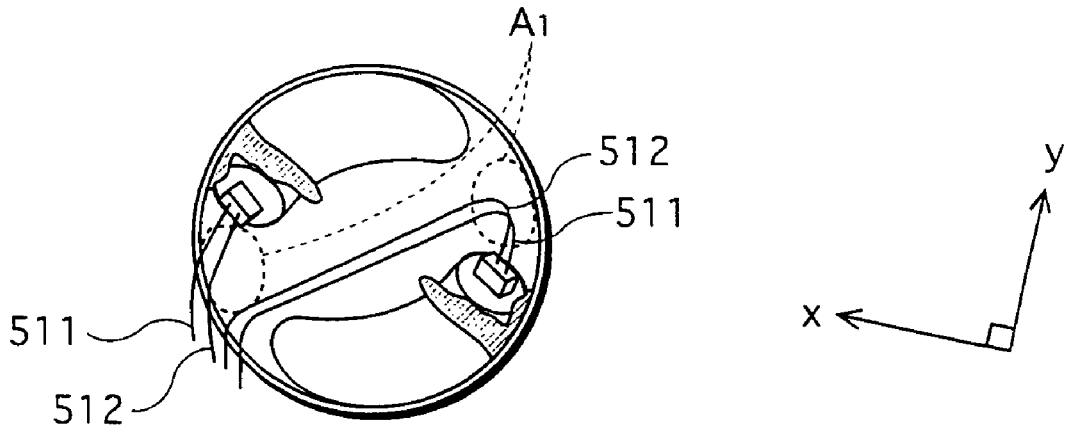
FIG. 14 includes a plan view illustrating how a spiral arc tube is fixed to a case, and a view illustrating a cross-section of part of the spiral arc tube fixed to the case.
Figure 14B:
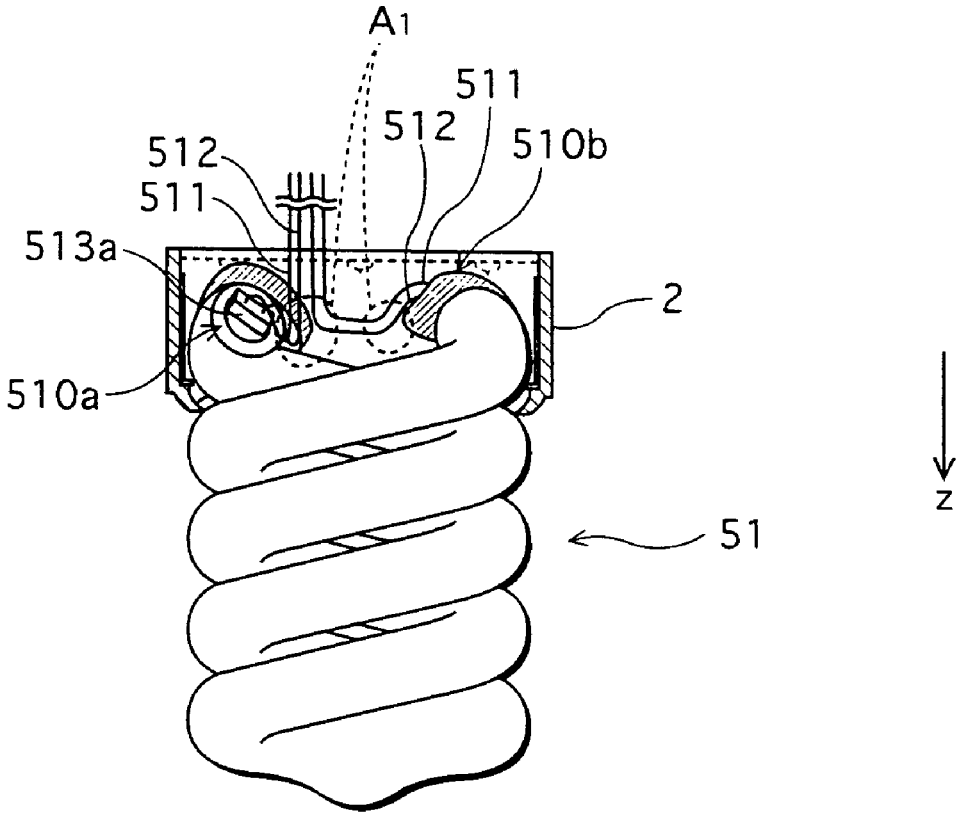

However, the lead wires 511 and 512 may extend downwards from each of the end portions 510*a* and 510*b* in the z-axis direction as shown in FIG. 14B.

FIG. 14 is a schematic view illustrating how the spiral arc tube 51 is attached to the holder 2 according to a modification example of the second embodiment, where FIG. 14A is a plan view and FIG. 14B is a side view.

As shown in FIG. 14B, if the lead wires 511 and 512 extend downwards from each of the end portions 510*a* and 510*b* in the z-axis direction, the lead wires 511 and 512 are positioned sufficiently distant from the circuit board 530 (shown in FIG. 8A). This reduces occurrence of a short circuit between the circuit board 530 and the lead wires 511 and 512.

The lead wires 511 and 512 extending from each of the end portions 510*a* and 510*b* may be fixed to the holder 2 using an insulating resin at an area A1 within a dashed circle in FIGS. 14A and 14B. Here, the area A1 is where the lead wires 511 and 512 are bent in the z-axis direction. In this way, the lead wires 511 and 512 are fixed so as to be separated from each other. This prevents occurrence of a short circuit between the lead wires 511 and 512. Furthermore, the fixing by means of the insulating resin absorbs a tension generated when the lead wires 511 and 512 are wound around the connection pins 532 (shown in FIG. 8A). Therefore, the tension is not transmitted to the end portions 510*a* and 510*b*. This reduces breakage of the sealing portions 513*a* and 513*b*.

Figure 15A:
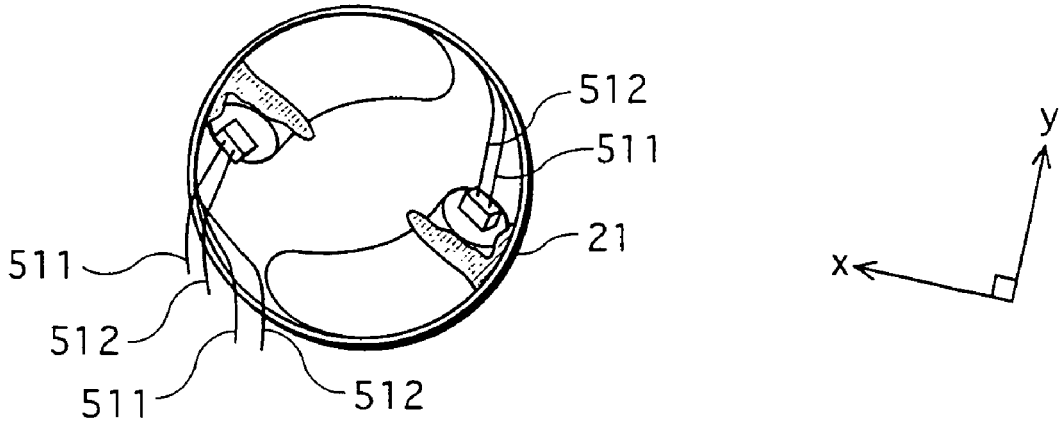
FIG. 15 includes a plan view illustrating how a spiral arc tube is fixed to a case, and a view illustrating a cross-section of part of the spiral arc tube fixed to the case.
Figure 15B:
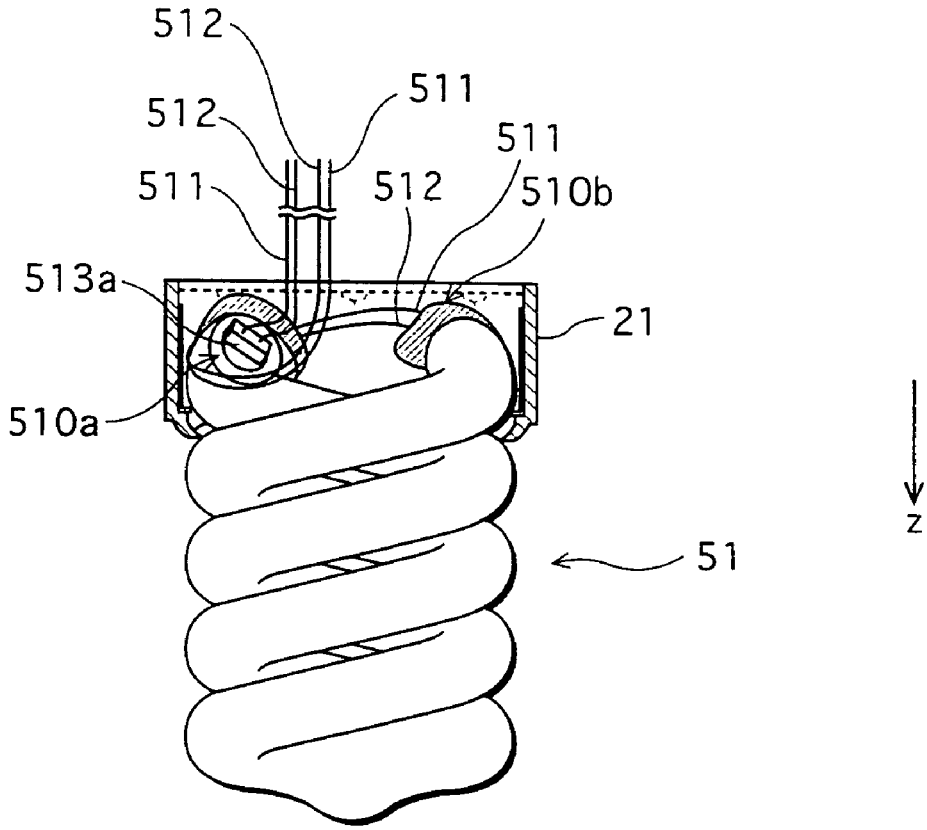

Alternatively, as shown in FIG. 15, the lead wires 511 and 512 extending from each of the end portions 510*a* and 510*b* may be first bent towards the wall 21 of the holder 2 so as to run along an inner surface of the wall 21. Thus, the lead wires 511 and 512 reach the vicinity of the connection pins 532 (shown in FIGS. 8A, 8B and 9), and are then bent upwards in the z-axis direction. In this way, since the lead wires 511 and 512 are positioned sufficiently distant from the circuit board 530 (shown in FIG. 8A), a short circuit between the circuit board 530 and the lead wires 511 and 512 is less likely to occur. Furthermore, since the bending produces an elasticity in the lead wires 511 and 512, the breakage of the sealing portions 513*a* and 513*b* can be reduced as in the first embodiment.

Figure 16A:
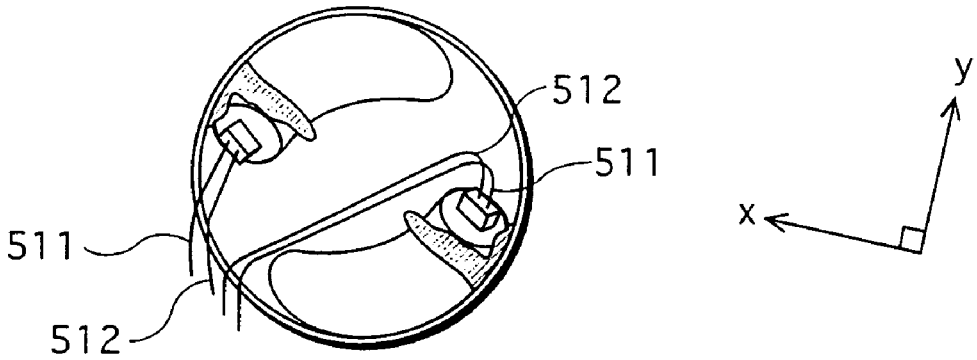
FIG. 16 includes a plan view illustrating how a spiral arc tube is fixed to a case, and a view illustrating a cross-section of part of the spiral arc tube fixed to the case.
Figure 16B:
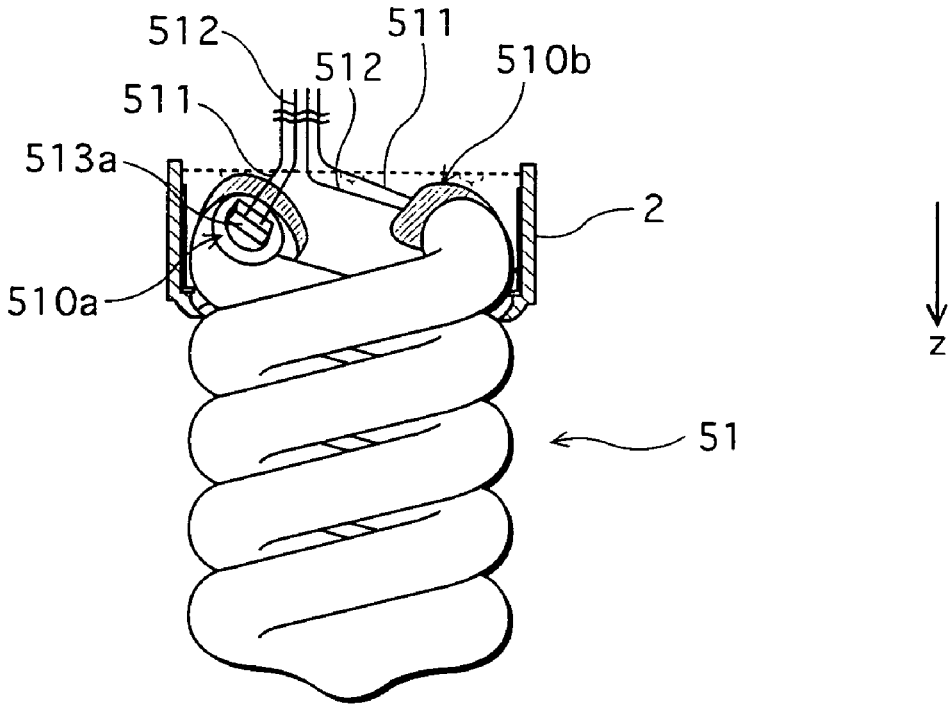

The lead wires 511 and 512 extending from each of the end portions 510*a* and 510*b* may be connected to the connection pins 532 without being bent, as shown in FIG. 16B. This reduces a chance that the lead wires 511 and 512 overlap each other, thereby reducing occurrence of a short circuit when compared with the compact self-ballasted fluorescent lamp shown in FIG. 3.

THIRD EMBODIMENT

According to the second embodiment, the four connection pins 532 are aligned in line on the circuit board 530. According to a third embodiment, however, a pair of connection pins is arranged, on a circuit board, in the vicinity of each end portion of a spiral arc tube, as in the first embodiment. The third embodiment is based on a combination of the first and second embodiments.

Figure 17A:
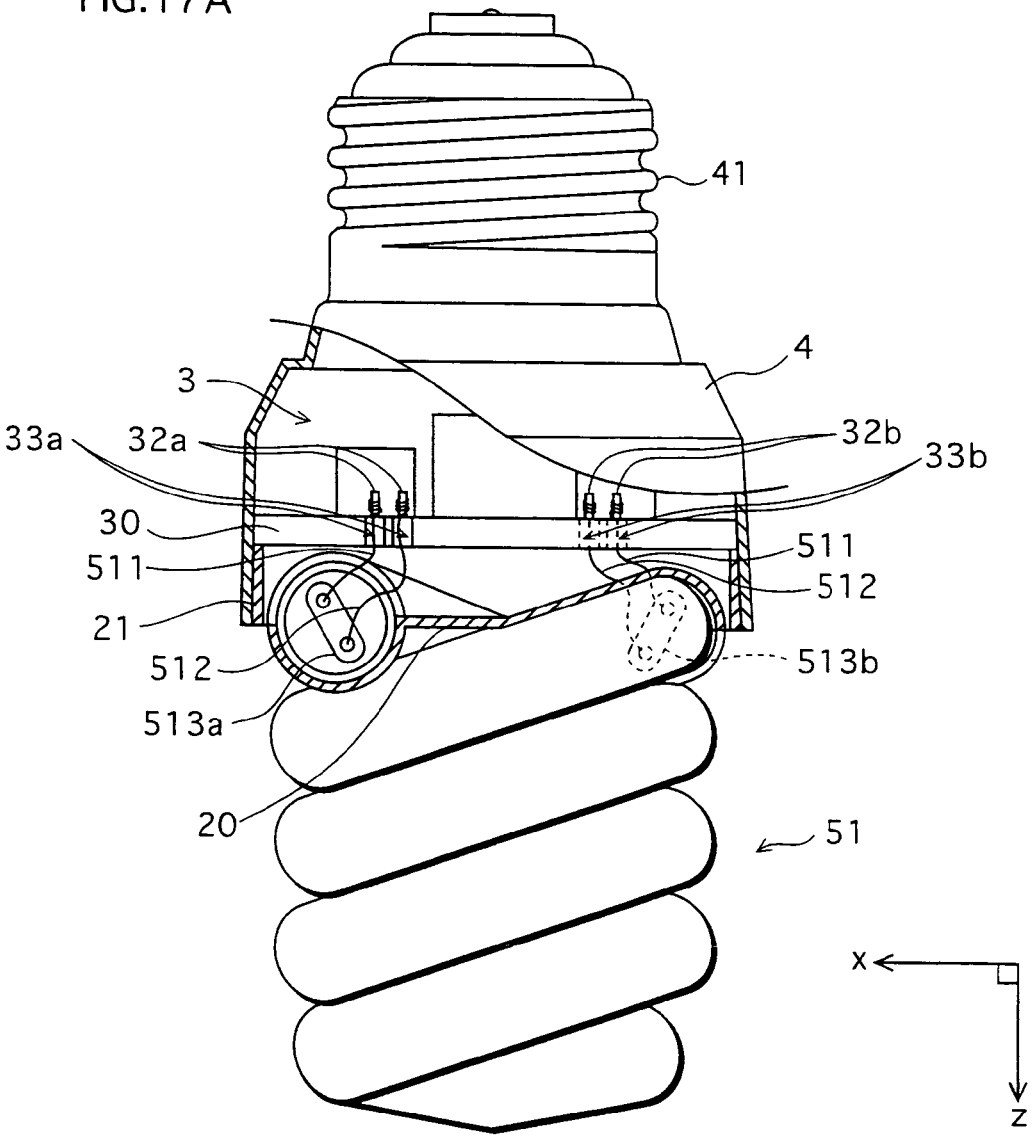
FIG. 17 is a front view illustrating a compact self-ballasted fluorescent lamp relating to a third embodiment, and shows an inner structure by removing a part of the lamp.
Figure 17B:
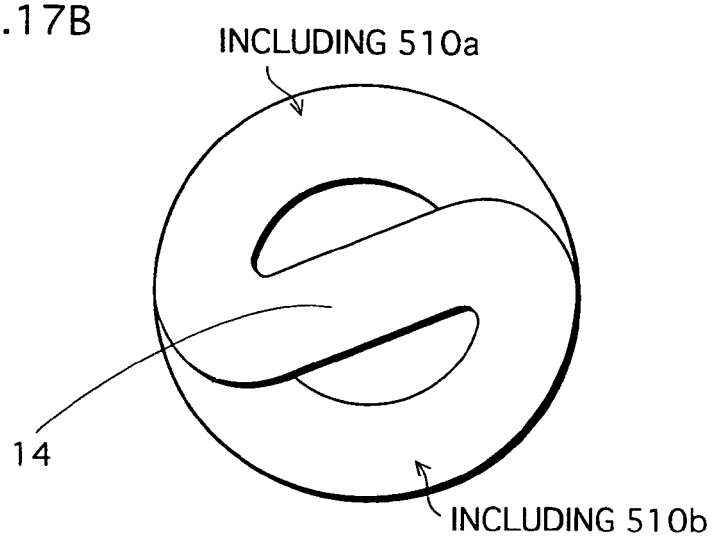
Figure 18:
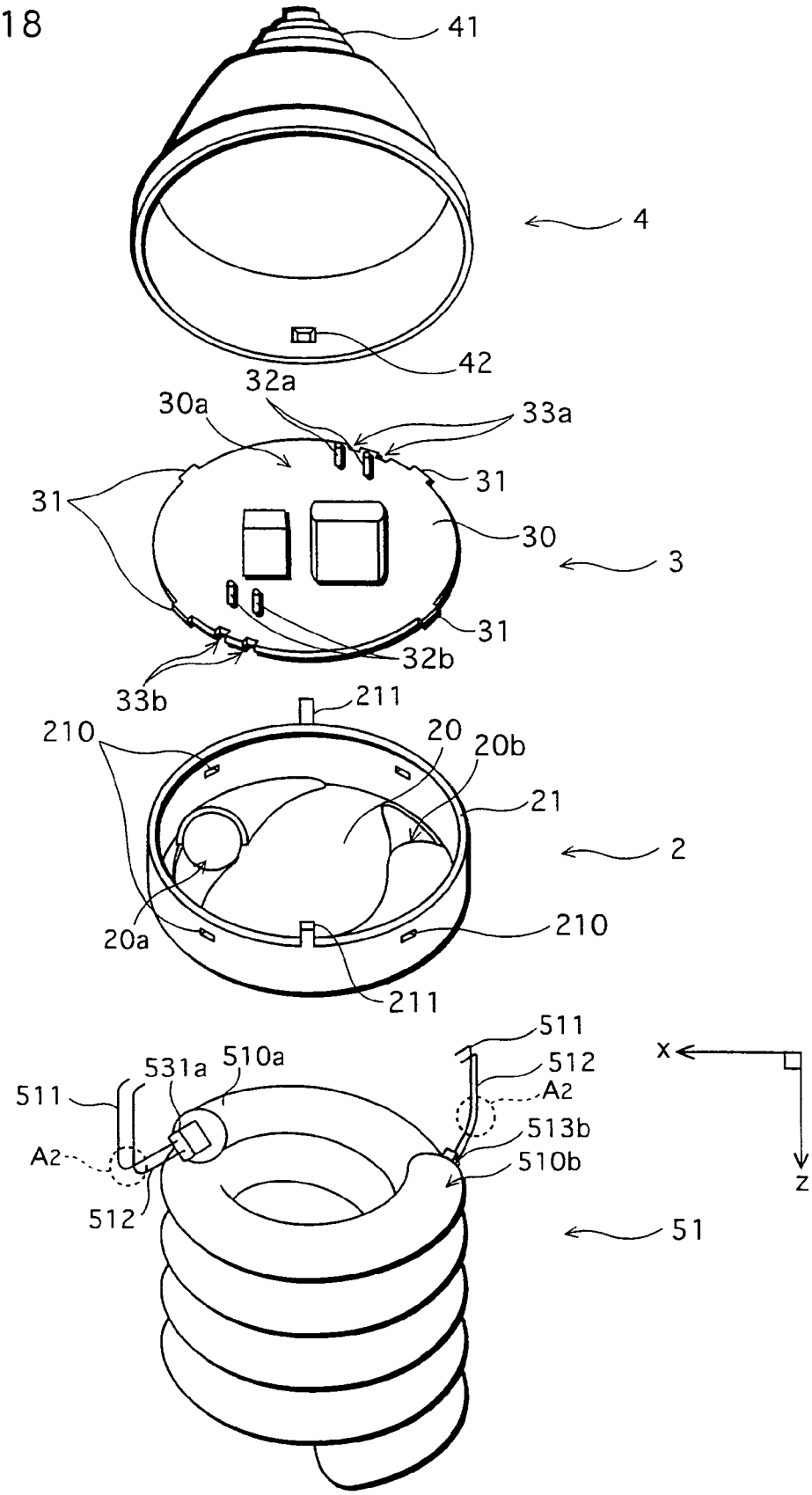
FIG. 18 is a perspective exploded view illustrating the compact self-ballasted fluorescent lamp relating to the third embodiment.

FIG. 17A is a front view illustrating a compact self-ballasted fluorescent lamp relating to the third embodiment and shows an inner structure by removing part of the lamp. FIG. 17B is a bottom plan view of the spiral arc tube 51. FIG. 18 is an exploded view illustrating the compact self-ballasted fluorescent lamp relating to the third embodiment. In FIGS. 17A, 17B and 18, the same reference numerals as in FIGS. 1A, 1B, 2, 8A, 8B and 9 are used to identify the same constituents.

As shown in FIGS. 17A, 17B and 18, the pair of connection pins 32*a* and the pair of connection pins 32*b* are respectively provided, on the circuit board 30, directly above (in the vicinity of) the end portions 510*a* and 510*b* of the spiral arc tube 51. In other words, the pairs of connection pins 32*a* and 32*b* are provided near the periphery of the circuit board 30 so as to oppose each other. Accordingly, the same effects as the first embodiment can be achieved. Specifically speaking, occurrence of a short circuit between the circuit board 30 and the lead wires 511 and 512 extending from each of the end portions 510*a* and 510*b* can be reduced. Furthermore, since the number of times the lead wires 511 and 512 are bent to be connected to each of the pairs of connection pins 32*a* and 32*b* can be reduced when compared with the compact self-ballasted fluorescent lamp shown in FIG. 3, breakage of the lead wires 511 and 512 can be reduced.

Furthermore, the sealing portions 513*a* and 513*b* of the spiral arc tube 51 are tilted with respect to the z-axis direction, which achieves the same effects as the second embodiment. Specifically speaking, when pulled upwards substantially vertically to be wound around the pairs of connection pins 32*a* and 32*b*, the lead wires 511 and 512 extending from each of the end portions 510*a* and 510*b* do not overlap each other. Therefore, the length of each of the lead wires 511 and 512 can be made shorter than in the second embodiment, with it being possible to reduce breakage of the lead wires 511 and 512. As a result, occurrence of a short circuit can be reduced more reliably.

Alternatively, the lead wires 511 and 512 extending from each of the end portions 510*a* and 510*b* may be bent to form a bending portion A2 (shown in FIG. 18) as described in the modification examples of the first and second embodiments (e.g. FIG. 5). Here, if the connection pins 32*a* and 32*b* are formed by wire-like components and the lead wires 511 and 512 are twisted together with each of the pairs of connections pins 32*a* and 32*b* to be connected with each other, an elasticity generated by the bending portions A2 reduces breakage of the lead wires 511 and 512. In addition, if the bending portions A2 are positioned sufficiently distant from the circuit board 30, the lead wires 511 are positioned sufficiently distant from the circuit board 30. This reduces occurrence of a short circuit between the circuit board 30 and the lead wires 511. The lead wires 511 and 512 may be fixed to the holder 2 at the bending portion A2, using a resin, like the bending portions A in FIGS. 5A and 5B and the bending portions A1 in FIGS. 14A and 14B. Since the fixing absorbs the tension generated when the lead wires 511 and 512 are twisted together with each of the pairs of connection pins 32*a* and 32*b*, breakage of the sealing portions 513*a* and 513*b* (in FIG. 17A) can be reduced.

INDUSTRIAL APPLICABILITY

The present invention is applicable to a compact self-ballasted fluorescent lamp that includes an arc tube having a spiral configuration and end portions being spirally wound, to achieve a larger light emission area and higher luminance.

The invention claimed is:

1. A compact self-ballasted fluorescent lamp comprising:

a spiral arc tube in a double spiral configuration which is formed by spirally winding a glass tube from a middle portion thereof to both end portions thereof inclusive, the spiral arc tube having pairs of electrically conductive lead wires that respectively support electrodes at the end portions; and a circuit board (i) on which pairs of connection members are provided so as to respectively connect the pairs of lead wires to the circuit board, and (ii) which applies a driving voltage to the electrodes through the pairs of lead wires to cause the spiral arc tube to emit light, wherein the spiral arc tube has a pinch seal configured part in which the end portions seal the pairs of lead wires, and the pinch surface of the pinch seal configured part is tilted with respect to a spiral axis of the spiral arc tube, and a straight line connecting locations from which the pairs of lead wires extend is tilted with respect to the spiral axis of the spiral arc tube so that the locations are positioned with an interval therebetween in a direction perpendicular to the spiral axis of the spiral arc tube.

2. The compact self-ballasted fluorescent lamp of claim 1, wherein the pairs of connection members are provided in a periphery portion of the circuit board in opposition to each other with the spiral axis of the spiral arc tube between the pairs of connection members, so as to correspond to the pairs of lead wires.

3. The compact self-ballasted fluorescent lamp of claim 2, wherein the pairs of lead wires have bending portions each of which has a spring function between the end portions and the pairs of connection members.

4. The compact self-ballasted fluorescent lamp of claim 3, wherein the bending portions are positioned more distant from the circuit board than the end portions are.

5. A compact self-ballasted fluorescent lamp comprising:

a spiral arc tube in a double spiral configuration which is formed by spirally winding a glass tube from a middle portion thereof to both end portions thereof inclusive, the spiral arc tube having pairs of electrically conductive lead wires that respectively support electrodes at the end portions; and a circuit board which is positioned in a vicinity of the end portions of the spiral arc tube, and to which the pairs of lead wires are connected, and which applies a driving voltage to the electrodes through the pairs of lead wires to cause the spiral arc tube to emit light, wherein a straight line connecting cross-sectional centers of the lead wires is tilted with respect to a spiral axis of the spiral arc tube, and at the end portion, one of the lead wires closer to the circuit board is positioned more distant from the spiral axis of the spiral arc tube.

6. The compact self-ballasted fluorescent lamp of claim 5, wherein the pairs of lead wires have bending portions each of which has a spring function between the end portions and the pairs of connection members.

7. The compact self-ballasted fluorescent lamp of claim 6, wherein the bending portions are positioned more distant from the circuit board than the end portions are.

* * * * *